US008358299B2

(12) United States Patent
Chaji et al.

(10) Patent No.: US 8,358,299 B2
(45) Date of Patent: Jan. 22, 2013

(54) LOW POWER CIRCUIT AND DRIVING METHOD FOR EMISSIVE DISPLAYS

(75) Inventors: G. Reza Chaji, Waterloo (CA); Arokia Nathan, Cambridge (GB)

(73) Assignee: Ignis Innovation Inc., Waterloo, Ontario (CA)

( * ) Notice: Subject to any disclaimer, the term of this patent is extended or adjusted under 35 U.S.C. 154(b) by 615 days.

(21) Appl. No.: 12/633,209

(22) Filed: Dec. 8, 2009

(65) Prior Publication Data

US 2010/0207920 A1 Aug. 19, 2010

(30) Foreign Application Priority Data

Dec. 9, 2008 (CA) ..... 2647112
Dec. 19, 2008 (CA) ..... 2654409

(51) Int. Cl.
*G09G 5/00* (2006.01)
*G09G 3/30* (2006.01)

(52) U.S. Cl. ..... 345/211

(58) Field of Classification Search ..... 345/211, 345/173, 93, 76, 77, 619, 102, 205, 60
See application file for complete search history.

(56) References Cited

U.S. PATENT DOCUMENTS 6,417,825 B1 * 7/2002 Stewart et al. ..... 345/77
7,112,820 B2 9/2006 Chang et al.

(Continued)

FOREIGN PATENT DOCUMENTS

WO 2005/022498 3/2005

(Continued)

OTHER PUBLICATIONS

Ahnood et al.: "Effect of threshold voltage instability on field effect mobility in thin film transistors deduced from constant current measurements"; dated Aug. 2009.

(Continued)

*Primary Examiner* — Fred Tzeng
(74) *Attorney, Agent, or Firm* — Nixon Peabody LLP

(57) ABSTRACT

A display system, a driver for driving the display array, method of operating the display system and a pixel circuit in the display system are provided. The driver includes: a bidirectional current source having a convertor coupling to a time-variant voltage, for converting the time-variant voltage to the current. The pixel circuit includes: a transistor for providing a pixel current to a light emitting device; and a storage capacitor electrically coupling to the transistor, the capacitor coupling to a time-variant voltage in a predetermined timing for providing a current based on the time-variant voltage. The method includes: in a first cycle in a programming operation, changing a time-variant voltage provided to a storage capacitor in a pixel circuit, from a reference voltage to a programming voltage, the storage capacitor electrically coupling to a driving transistor for driving a light emitting device; and in a second cycle in the programming operation, maintaining the time-variant voltage at the programming voltage. The method includes: in a programming operation, providing programming data to a pixel circuit from a data line, the pixel circuit including a transistor coupling to the data line and a storage capacitor; and in a driving operation, providing, to the storage capacitor in the pixel circuit via a power supply line, a time-variant voltage for turning on a light emitting device. The pixel circuit, which includes: an organic light emitting diode (OLED) device having an electrode and an OLED layer; and an inter-digitated capacitor having a plurality of layers.

25 Claims, 30 Drawing Sheets

U.S. PATENT DOCUMENTS

| | | | | |
|---|---|---|---|---|
| 7,515,124 | B2 * | 4/2009 | Yaguma et al. | 345/76 |
| 7,604,718 | B2 * | 10/2009 | Zhang et al. | 204/230.6 |
| 7,683,899 | B2 * | 3/2010 | Hirakata et al. | 345/211 |
| 7,688,289 | B2 * | 3/2010 | Abe et al. | 345/76 |
| 7,808,008 | B2 * | 10/2010 | Miyake | 257/80 |
| 7,978,170 | B2 * | 7/2011 | Park et al. | 345/102 |
| 2004/0256617 | A1 * | 12/2004 | Yamada et al. | 257/59 |
| 2005/0248515 | A1 | 11/2005 | Naugler et al. | |
| 2006/0038750 | A1 * | 2/2006 | Inoue et al. | 345/60 |
| 2006/0038762 | A1 | 2/2006 | Chou | |
| 2008/0001544 | A1 | 1/2008 | Murakami et al. | |
| 2008/0122819 | A1 * | 5/2008 | Cho et al. | 345/205 |
| 2008/0231641 | A1 * | 9/2008 | Miyashita | 345/619 |
| 2008/0290805 | A1 | 11/2008 | Yamada et al. | |
| 2009/0009459 | A1 * | 1/2009 | Miyashita | 345/93 |

FOREIGN PATENT DOCUMENTS

| | | |
|---|---|---|
| WO | 2006/128069 | 11/2006 |

OTHER PUBLICATIONS

Alexander et al.: "Pixel circuits and drive schemes for glass and elastic AMOLED displays"; dated Jul. 2005 (9 pages).
Ashtiani et al.: "AMOLED Pixel Circuit With Electronic Compensation of Luminance Degradation"; dated Mar. 2007 (4 pages).
Chahi et al.: "An Enhanced and Simplified Optical Feedback Pixel Circuit for AMOLED Displays"; dated Oct. 2006.
Chaji et al.: "A Current-Mode Comparator for Digital Calibration of Amorphous Silicon Amoled Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with Ignis Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker reduction for biomolecular imaging"; dated Jul. 2008 (4 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Thin-Film Transistor Integration for Biomedical Imaging and AMOLED Displays"; dated 2008 (177 pages).
International Search Report for International Application No. PCT/CA2009/001769 dated Apr. 8, 2010.
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Written Opinion for International Application No. PCT/CA2009/001769 dated Apr. 8, 2010 (8 pages).
Supplementary European Search Report for European Application No. 09831339.8 dated Mar. 26, 2012 (11 pages).

* cited by examiner $$V1 = VB - \sqrt{\frac{IB}{\beta}} - VT$$

$$V1 = VB - \sqrt{\frac{IB}{\beta}} - VT$$

LOW POWER CIRCUIT AND DRIVING METHOD FOR EMISSIVE DISPLAYS

FIELD

The disclosed embodiments relate to a light emitting display, and more specifically to a method and system for driving the light emitting display.

BACKGROUND

Electro-luminance displays have been developed for a wide variety of devices, such as cell phones, Personal Digital Assistants (PDAs). Such displays include a liquid crystal display (LCD), a field emission display (FED), a plasma display panel (PDP), a light emitting display (LED), etc. In particular, active-matrix organic light emitting diode (AMOLED) displays with amorphous silicon (a-Si), polysilicon, organic, or other driving backplane have become more attractive due to advantages, such as feasible flexible displays, its low cost fabrication, high resolution, and a wide viewing angle.

On method employed to drive an emissive display is to program a pixel directly with current (e.g., current driven OLED devices). However, a small current required by OLED, coupled with a large parasitic capacitance, increases the settling time of the programming of the AMOLED display. Furthermore, it is difficult to design an external driver to provide an accurate and constant drive current. There is a demand for high resolution displays with high aperture ratio or fill factor (defined as the ratio of light emitting display area to the total pixel area), ensuring high display quality. There is also a demand of reducing a size and power consumption of a device having a display.

There is a need to provide a display system and its operation method that can improve the lifetime, image uniformity, stability and/or yield of the display, and can provide a high-resolution stable low power display.

SUMMARY

The aspects of the disclosed embodiments provide a method and system that obviates or mitigates at least one of the disadvantages of existing systems.

According to an aspect of embodiments of the present application there is provided a driver for driving a display system, which includes: a bidirectional current source for providing a current to a display system, including: a convertor coupling to a time-variant voltage, for converting the time-variant voltage to the current, and a controller for controlling the generation of the time-variant voltage.

According to another aspect of the embodiments of the present application there is provided a pixel circuit, which includes: a transistor for providing a pixel current to a light emitting device; and a storage capacitor electrically coupling to the transistor, the capacitor coupling to a time-variant voltage in a predetermined timing for providing a current based on the time-variant voltage.

According to a further aspect of the embodiments of the present application there is provided a method of operating a pixel circuit, which includes: in a first cycle in a programming operation, changing a time-variant voltage provided to a storage capacitor in a pixel circuit, from a reference voltage to a programming voltage, the storage capacitor electrically coupling to a driving transistor for driving a light emitting device; and in a second cycle in the programming operation, maintaining the time-variant voltage at the programming voltage.

According to a further aspect of the embodiments of the present application there is provided a method of operating a pixel circuit, which includes: in a programming operation, providing programming data to a pixel circuit from a data line, the pixel circuit including a transistor coupling to the data line and a storage capacitor; and in a driving operation, providing, to the storage capacitor in the pixel circuit via a power supply line, a time-variant voltage for turning on a light emitting device.

According to a further aspect of the embodiments of the present application there is provided a pixel circuit, which includes: an organic light emitting diode (OLED) device having an electrode and an OLED layer; and an inter-digitated capacitor having a plurality of layers, for operating the OLED, the OLED device being disposed on the plurality of layers, one of the layers of the inter-digitated capacitor being interconnected to the electrode of the OLED.

BRIEF DESCRIPTION OF THE DRAWINGS

These and other features of the invention will become more apparent from the following description in which reference is made to the appended drawings wherein.

DETAILED DESCRIPTION

One or more currently preferred embodiments have been described by way of example. It will be apparent to persons skilled in the art that a number of variations and modifications can be made without departing from the scope of the invention as defined in the claims.

Embodiments of the present invention are described using a display system that may be fabricated using different fabrication technologies including, for example, but not limited to, amorphous silicon, poly silicon, metal oxide, conventional CMOS, organic, anon/micro crystalline semiconductors or combinations thereof. The display system includes a pixel that may have a transistor, a capacitor and a light emitting device. The transistor may be implemented in a variety of materials systems technologies including, amorphous Si, micro/nano-crystalline Si, poly-crystalline Si, organic/polymer materials and related nanocomposites, semiconducting oxides or combinations thereof. The capacitor can have different structure including metal-insulator-metal and metal-insulator-semiconductor. The light emitting device may be, for example, but not limited to, an OLED. The display system may be, but not limited to, an AMOLED display system.

In the description, "pixel circuit" and "pixel" may be used interchangeably. Each transistor may have a gate terminal and two other terminals (first and second terminals). In the description, one of the terminals or "first terminal" (the other terminal or "second terminal") of a transistor may correspond to, but not limited to, a drain terminal (a source terminal) or a source terminal (a drain terminal).

To reduce the fabrication cost, most of fabrication technologies, used in display backplane, offer only one type of transistors. Since each type of transistor is intrinsically good for uni-directional current source, pixel circuits and/or peripheral driver circuits become complicated, resulting in reducing yield, resolution, and aperture ratio. On the other hand, capacitance is available in all technology.

Figure 1:
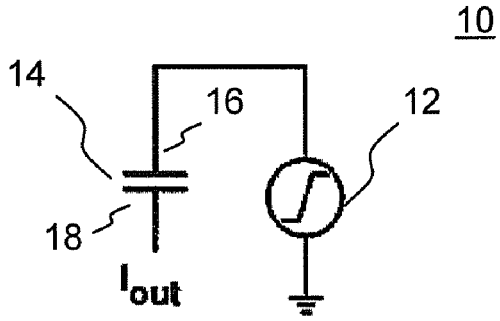
FIG. 1 illustrates a bidirectional current source in accordance with an embodiment of the disclosure.

A current driving technique using a differentiator/convertor to convert a time-variant voltage to a current is described. In the description, a capacitor is used to convert a ramp voltage to a current (e.g., a DC current). Referring to FIG. 1, there is illustrated a current source developed based on a capacitance. The current source 10 of FIG. 1 is a bidirectional current source that can provide positive and negative currents. The current source 10 includes a voltage generator 12 for generating a time-variant voltage and a driving capacitor 14. The voltage generator 12 is coupled to one end terminal 16 of the driving capacitor 14. A node "Iout" is coupled to the other end terminal 18 of the driving capacitor 14. In this example, a ramp voltage is generated by the voltage generator 12. In the embodiments, the terms "capacitive current source", "capacitive current source driver", "capacitive driver" and "current source" may be used interchangeably. In the embodiments, the terms "voltage generator" and "ramp voltage generator" may be used interchangeably. In FIG. 1, the current source 10 includes the ramp voltage generator 12, however, the current source 10 may be formed by the driving capacitor 14 that receives the ramp voltage.

It is assumed that the node "Iout" is a virtual ground. A ramp voltage is applied to the terminal 16 of the driving capacitor 14, resulting in a fixed current passing the driving capacitor 14 and going to Iout. $i(t)=CdVR(t)/dt$ (C: Capacitance, VR(t): ramp voltage). Amplitude and sign of the ramp's slope are controllable (changeable), which can change the value and direction of the output current. Also, the amount of the driving capacitor 14 can change the current value. As a result, a digitized capacitance based on the capacitive current source 10 can be used to develop a simple and effective current mode analog-to-digital convertor (ADC) resulting in small and low power driver. Also it provides a simple source driver that can be easily integrated on the panel, independent of fabrication technology, resulting in improving the yield and simplicity of the display and reducing the system cost significantly.

In one example, the capacitive current source 10 can be used to provide a programming current to a current programmed pixel (e.g., OLED pixels). In another example, the capacitive current source 10 can be used to provide a bias current for accelerating the programming of a pixel (e.g., current biased voltage programmed pixels in FIGS. 8-16 and voltage biased current programmed pixels in FIGS. 17-19). In a further example, the capacitive current source 10 can be used to drive a pixel. The capacitive driving technique with the capacitive current source 10 improves the settling time of the programming/driving, which is suitable for larger and higher resolution displays, and thus a low-power high resolution emissive display can be realized with the capacitive current source 10, as described below. The capacitive driving technique with the capacitive current source 10 compensates for TFT aging (e.g., threshold voltage variations), and thus can improve the uniformity and lifetime of the display, as described below.

In a further example, the capacitive current source 10 may be used with a current mode analog-to-digital convertor (ADC), for example, to provide a reference current to the current mode ADC where input current is converted to digital signals. In a further example, the capacitive driving may be used for a digital to analog convertor (DAC) where current is generated based on the ramp voltage and the capacitor.

Figure 2:
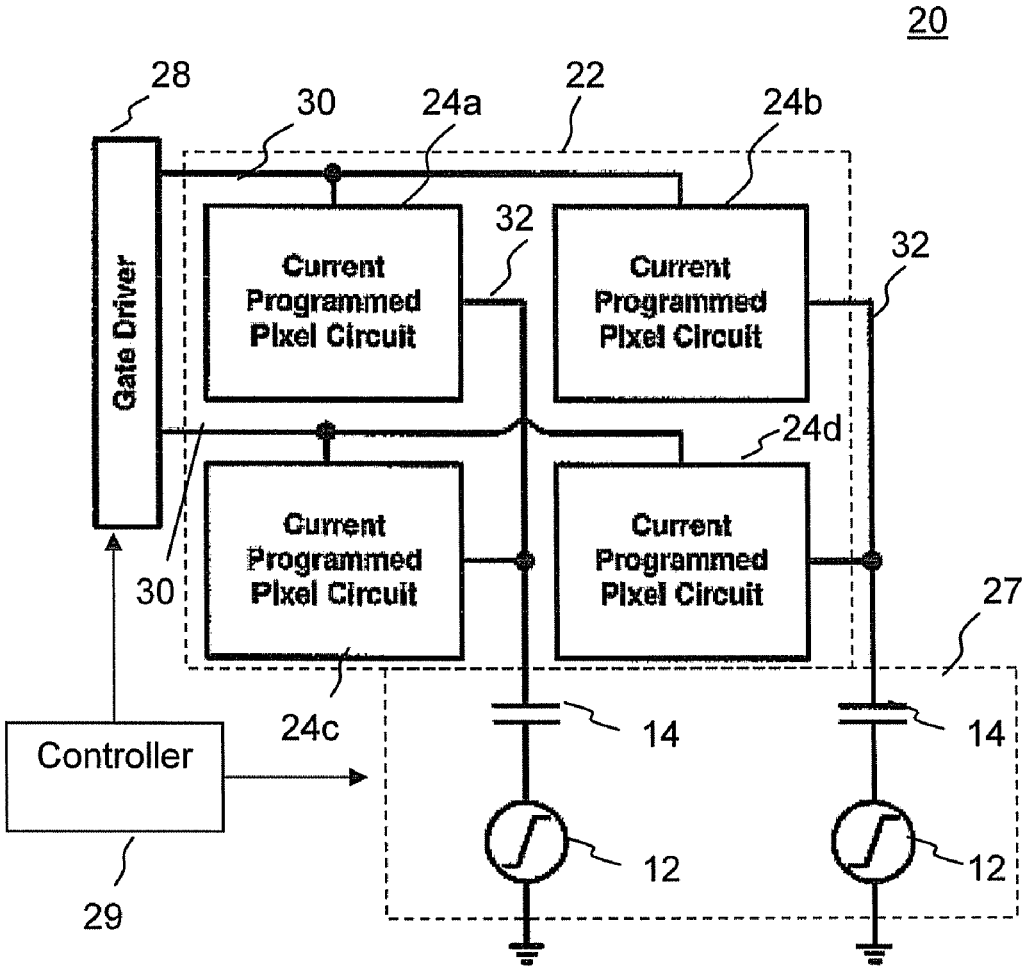
FIG. 2 illustrates an example of a display system with the bidirectional current source of FIG. 1.

Referring to FIG. 2, there is illustrated an example of an integrated display system with the capacitive driver 10. The integrated display system 20 of FIG. 2 includes a pixel array 22 having a plurality of pixels 24*a*-24*d* arranged in columns and rows, a gate driver 28 for selecting a pixel, and a source driver 27 for providing programming current to the selected pixel.

The pixels 24*a*-24*d* are current programmed pixel circuits. Each pixel includes, for example, a storage capacitor, a driving transistor, a switch transistor (or a driving and switching transistor), and a light emitting device. In FIG. 2, four pixels are shown; however, it would be appreciated by one of ordinary skill in the art that the number of the pixels in the pixel array 22 is not limited to four and may vary. The pixel array 22 may include a current biased voltage programmed (CBVP) pixel (e.g., FIGS. 8-16) or a voltage biased voltage programmed (VBCP) pixel (e.g., FIGS. 17-19) where the pixel is operated based on current and voltage. The CBVP driving technique and the VBCP driving technique are suitable for the use in AMOLED displays where they enhance the settling time of the pixels.

Each pixel is coupled to an address line 30 and a data line 32. Each address line 30 is shared among the pixels in a row. Each data line 32 is, shared among the pixels in a column. The gate driver 28 drives a gate terminal of the switch transistor in the pixel via the address line 30. The source driver 27 includes the capacitive driver 10 for each column. The capacitive driver 10 is coupled to the data line 32 in the corresponding column. The capacitive driver 10 drives the data line 32. A controller 29 is provided to control and schedule programming, calibration, driving and other operations for the display array 22. The controller 29 controls the operation of the source driver 27 and the gate driver 28. Each ramp voltage generator 12 may be calibrated. In the display system 20, the driving capacitor 14 is implemented, for example, on the edge of the display.

At the beginning of providing a ramp voltage, the capacitance (driving capacitor 14) acts as a voltage source and adjusting the voltage of the data line 32. After the voltage of the data line 32 reaches a certain proper voltage, the data line 32 acts as a virtual ground ("Iout" of FIG. 1). Thus, the capacitance will act as a current source for providing a constant current, after this point. This duality results in a fast settling programming.

In FIG. 2, the driving capacitor 14 and the storage capacitor of the pixel are separately allocated. However, the driving capacitor 14 may be shared with the storage capacitor of the pixel as shown in FIG. 3.

Figure 3:
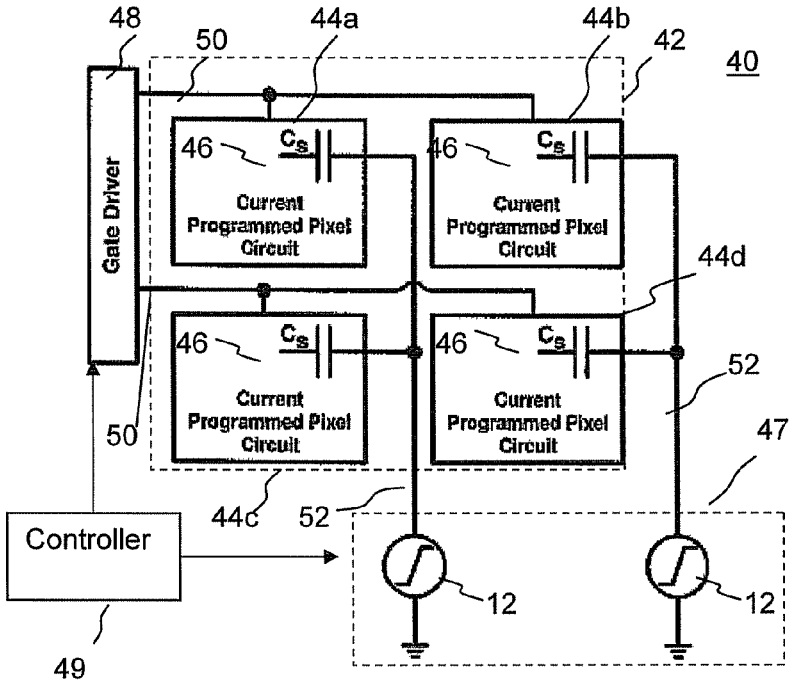
FIG. 3 illustrates a further example of a display system with the bidirectional current source of FIG. 1.

Referring to FIG. 3, there is illustrated another example of an integrated display system with the capacitive driver 10 of FIG. 1. The integrated display system 40 of FIG. 3 includes a pixel array 42 having a plurality of pixels 44*a*-44*d* arranged in columns and rows. The pixels 44*a*-44*d* are current programmed pixel circuits, and may be same as the pixels 24*a*-24*d* of FIG. 2. In FIG. 3, four pixels are shown; however, it would be appreciated by one of ordinary skill in the art that the number of the pixels in the pixel array 42 is not limited to four and may vary. Each pixel includes, for example, a storage capacitor, a driving transistor, a switch transistor (or a driving and switching transistor), and a light emitting device. For example, the pixel array 42 may include the pixel of FIG. 6A where the pixel is operated based on programming voltage and current bias.

Each pixel is coupled to the address line 50 and the data line 52. Each address line 50 is shared among the pixels in a row. A gate driver 48 drives a gate terminal of the switch transistor in the pixel via the address line 50. Each data line 52 is shared among the pixels in a column, and is coupled to a capacitor 46 in each pixel in the column. The capacitor 46 in each pixel in the column is coupled to the ramp voltage generator 12 via the data line 52. A source driver 47 includes the ramp voltage generator 12. The ramp voltage generator 12 is allocated to each column. A controller 49 is provided to control and schedule programming, calibration, driving and other operations for the display array 42. The controller 49 controls the gate driver 48 and the source driver 47 having the ramp voltage generator 12. In the display system 40, the capacitor 46 in the pixel acts as a storage capacitor for the pixel and also acts as driving capacitance (capacitor 14 of FIG. 1).

Figure 4:
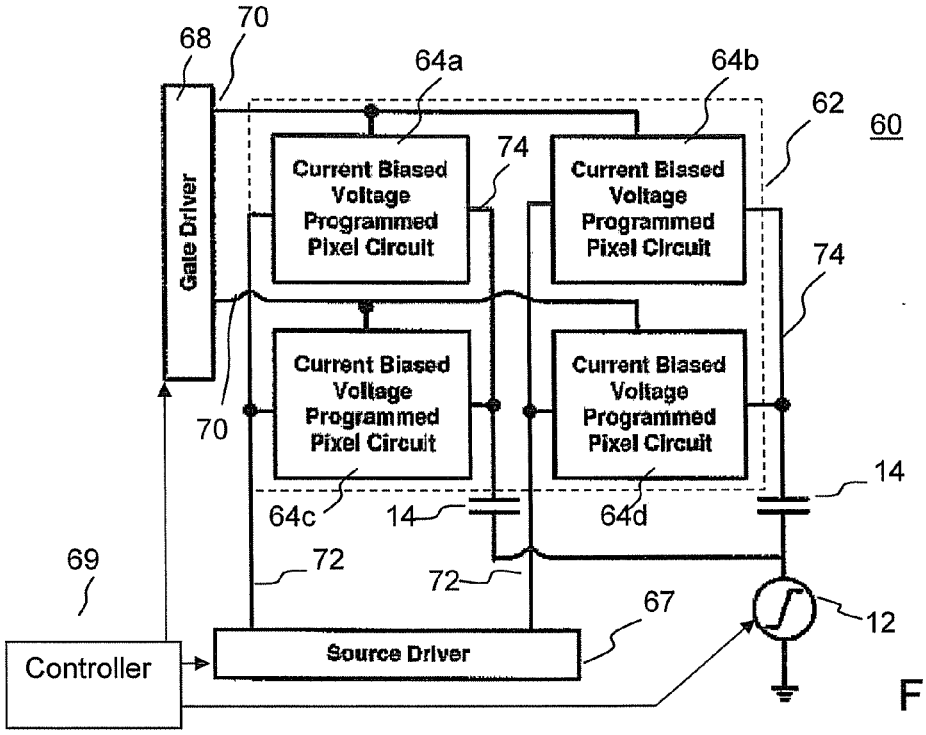
FIG. 4 illustrates a further example of a display system with the bidirectional current source of FIG. 1.

Referring to FIG. 4, there is illustrated a further example of an integrated display system with the capacitive driver 10 of FIG. 1. The integrated display system 60 of FIG. 4 includes a pixel array 62 having a plurality of pixels 64*a*-64*d* arranged in columns and rows. In FIG. 4, four pixels are shown; however, it would be appreciated by one of ordinary skill in the art that the number of the pixels in the pixel array 62 is not limited to four and may vary. The pixels 64*a*-64*d* are CBVP pixel circuits, each coupling to an address line 70, a data line 72, and a current bias line 74. The pixel array 62 may include CBVP pixels of FIGS. 8-16.

Each address line 70 is shared among the pixels in a row. A gate driver 68 drives a gate terminal of a switch transistor in the pixel via the address line 70. Each data line 72 is shared among the pixels in a column, and is coupled to a source driver 67 for providing programming data. The source driver 67 may further provide bias voltage (e.g., Vdd of FIG. 6). Each bias line 74 is shared among the pixels in a column. The driving capacitor 14 is allocated to each column and is coupled to the bias line 74 and the ramp voltage generator 12. The ramp voltage generator 12 is shared by more than one column. A controller 69 is provided to control and schedule programming, calibration, driving and other operations for the display array 62. The controller 69 controls the source driver 67, the gate driver 68, and the ramp voltage generator 12. In the display system 60, the capacitive current sources are easily put on the peripheral of the panel, resulting in reducing the implementation cost. In FIG. 4, the ramp voltage generator 12 is illustrated separately from the source driver 67. However, the source driver 67 may provide the ramp voltage.

A display system having a CBVP pixel circuit uses voltage to provide for different gray scales (voltage programming), and uses a bias to accelerate the programming and compensate for the time dependent parameters of a pixel, such as a threshold voltage shift and OLED voltage shift. A driver for driving a display array having the CBVP pixel circuit converts pixel luminance data into voltage. According to the CBVP driving scheme, the overdrive voltage is generated and provided to the driving transistor, which is independent from its threshold voltage and the OLED voltage. The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits. Since the settling time of the pixel circuits is much smaller than conventional pixel circuits, it is suitable for large-area display such as high definition TV, but it also does not preclude smaller display areas either. The capacitive driving technique is applicable to the CBVP display to further improve the settling time suitable for larger and higher resolution displays.

Figure 5:
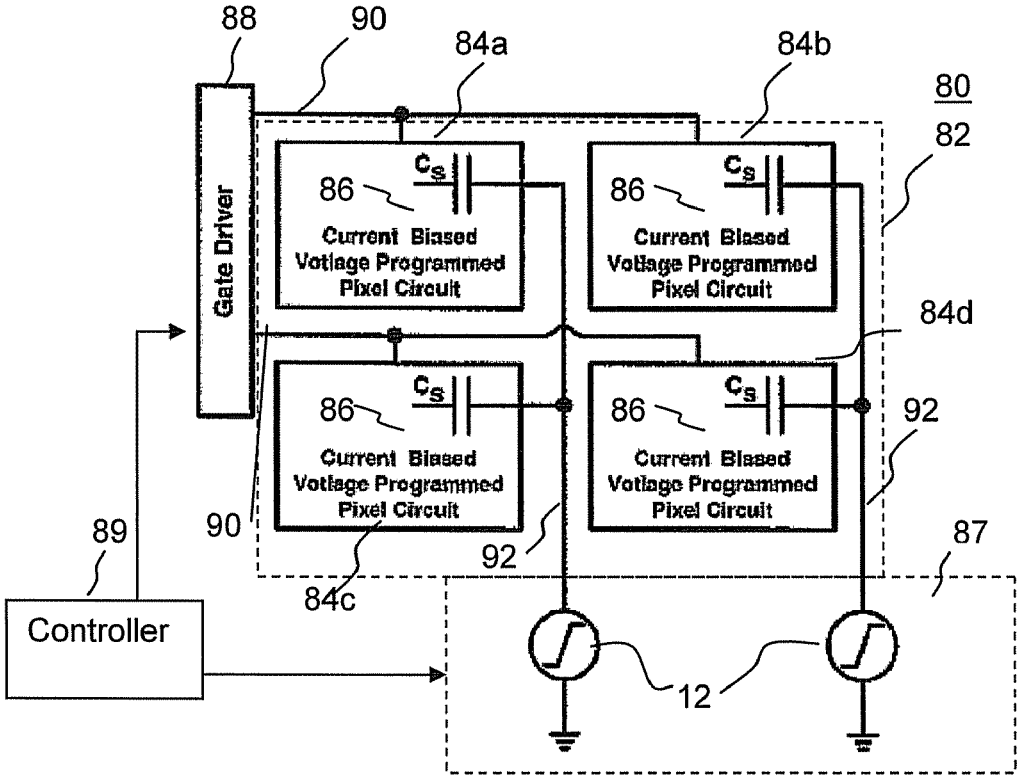
FIG. 5 illustrates a further example of a display system with the bidirectional current source of FIG. 1.

The capacitive driving technique provides a unique opportunity to share the current bias line and voltage data line in CBVP displays. Referring to FIG. 5 there is illustrated a further example of an integrated display system with the capacitive driver 10 of FIG. 1. The integrated display system 80 of FIG. 5 includes a pixel array 82 having a plurality of pixels 84*a*-84*d* arranged in columns and rows. The pixels 84*a*-84*d* are CBVP pixel circuits, and may be same as the pixels 64*a*-64*d* of FIG. 4. In FIG. 5, four pixels are shown; however, it would be appreciated by one of ordinary skill in the art that the number of the pixels in the pixel array 82 is not limited to four and may vary. Each pixel is coupled to the address line 90 and the voltage data/current bias line 92.

Each address line 90 is shared among the pixels in a row. A gate driver 88 drives a gate terminal of the switch transistor in the pixel via the address line 90. Each voltage data/current bias line 92 is shared among the pixels in a column, and is coupled to a capacitor 86 in each pixel in the column. The capacitor 86 in each pixel in the column is coupled to the ramp voltage generator 12 via the voltage data/current bias line 92. A source driver 87 has the ramp voltage generator 12. The ramp voltage generator 12 is allocated to each column. A controller 89 is provided to control and schedule programming, calibration, driving and other operations for the display array 82. The controller 89 controls the gate driver 88 and the source driver 87 having the ramp voltage generator 12. The data voltage and the biasing current are carried over through the voltage data/current bias line 92. In the display system 80, the capacitor 86 in the pixel acts as a storage capacitor for the pixel and also acts as driving capacitance (capacitor 14 of FIG. 1).

Figure 6A:
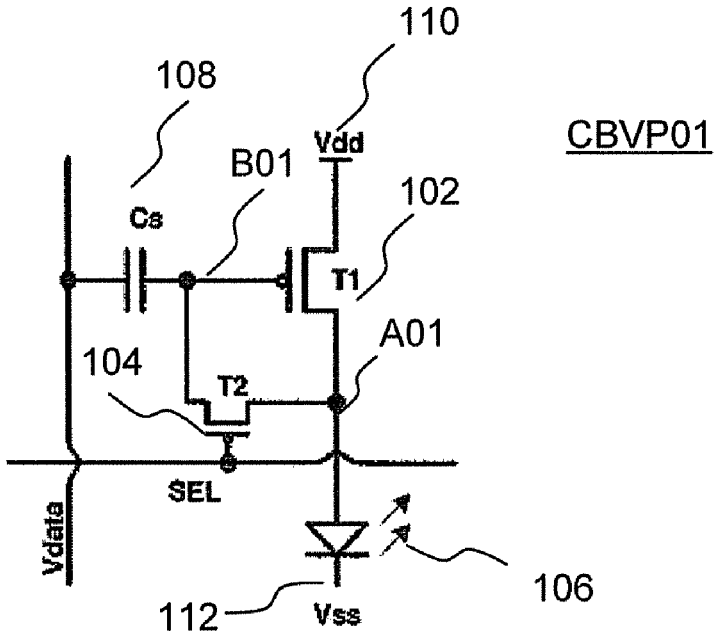
FIG. 6A illustrates an example of a current biased voltage programmed pixel circuit applicable to the display system of FIG. 5.

Referring to FIG. 6A, there is illustrated an example of a CBVP pixel circuit which is applicable to the pixel of FIG. 5. The pixel circuit CBVP01 of FIG. 6 includes a driving transistor 102, a switch transistor 104, a light emitting device 106, and a capacitor 108. In FIG. 6A, the transistors 102 and 104 are p-type transistors; however, one of ordinary skill in the art would appreciate that a CBVP pixel having n-type transistors is also applicable as the pixel of FIG. 5.

The gate terminal of the driving transistor 102 is coupled to the capacitor 108 at B01. One of the first and second terminals of the driving transistor 102 is coupled a power supply (Vdd) 110 and the other is coupled to the light emitting device 106 at node A01. The light emitting device 106 is coupled to a power supply (Vss) 112. The gate terminal of the switch transistor 104 is coupled to an address line SEL. One of the first and second terminals of the switch transistor 104 is coupled to the gate of the driving transistor 102 and the other is coupled to the light emitting device 106 and the driving transistor 102 at A01. The capacitor 108 is coupled between a data line Vdata and the gate terminal of the driving transistor 102. The capacitor 108 acts as a storage capacitor and a capacitive current source (14 of FIG. 1) as a driver element.

The capacitor 108 corresponds to the capacitor 86 of FIG. 5. The address line SEL corresponds to the address line 90 of FIG. 5. The data line Vdata corresponds to the voltage data/current bias line 92 of FIG. 5, and is coupled to the ramp voltage generator (12 of FIG. 1). The source driver 87 of FIG. 5 operates on the data line Vdata to provide a bias signal and programming data (Vp) to the pixel.

Figure 6B:
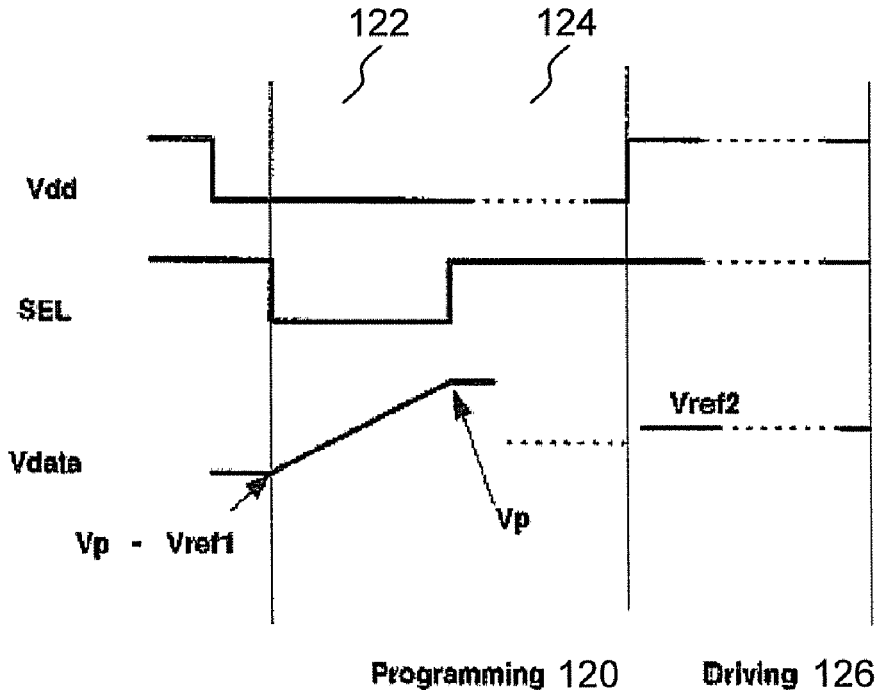
FIG. 6B illustrates an example of a timing diagram for the pixel circuit of FIG. 6A.

In FIG. 6A, the ramp voltage is used to carry the bias current while the initial voltage of the ramp (Vref1−Vp) is used to send the programming voltage to the pixel circuit CBVP01, as shown in FIG. 6B.

Referring to FIGS. 6A and 6B, the operation cycles of the pixel circuit CBVP01 includes a programming cycle 120 and a driving cycle 126. The power supply Vdd coupled to the driving transistor 102 is low during the programming cycle 120. In the initial stage 122 of the programming cycle 120, a ramp voltage is provided to the data line Vdata. The voltage of the Vdata goes from (Vref1−Vp) to Vp where Vp is a programming voltage for programming the pixel and Vref1 is a reference voltage. During the initial stage 122, the address line SEL is set to a low voltage so that the switch transistor 104 is on. During the initial stage 122, the capacitor 108 acts as a current source. The voltage of node A01 goes to $VB_{T1}$ where VB is a function of T1's characteristics (T1: the driving transistor 102) and the voltage of node B01 goes to $VB_{T1}+Vr_{T2}$ where $Vr_{T2}$ is the voltage drop across T2 (T2: the switch transistor 104)

At the next stage 124 after the initial stage 122, the voltage of Vdata remains Vp, and the address line SEL goes high to render the switch transistor 104 off. During the stage 124, the capacitor 108 acts as a storage element. During the driving cycle 126, the data line Vdata goes to Vref2 and stay at Vref2 for the rest of the frame.

Vref1 defines the level of bias current Ibias and it is determined, for example, based on TFT, OLED, and display characteristics and specifications. Vref2 is a function of Vref1 and pixel characteristics.

Figure 7A:
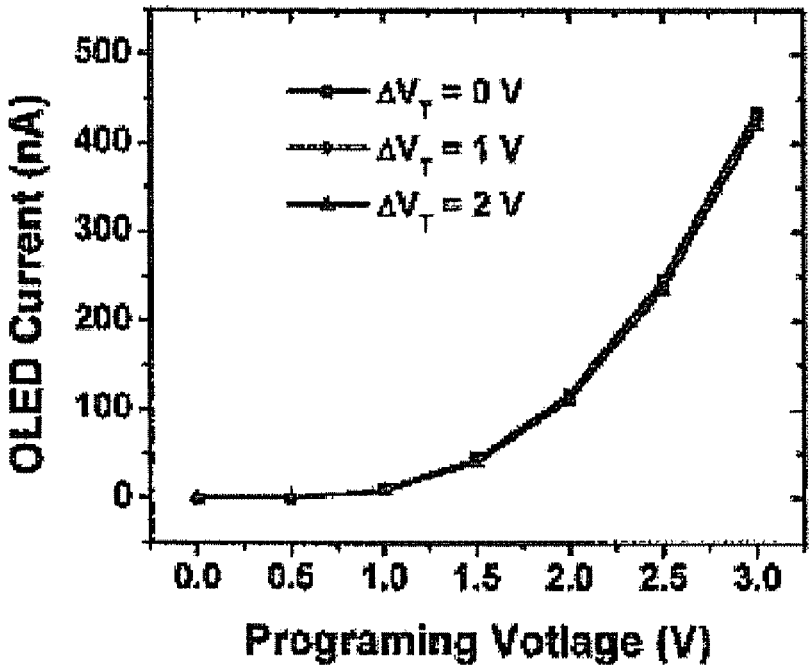
FIG. 7A illustrates simulation results for the pixel circuit of FIG. 6A.
Figure 7B:
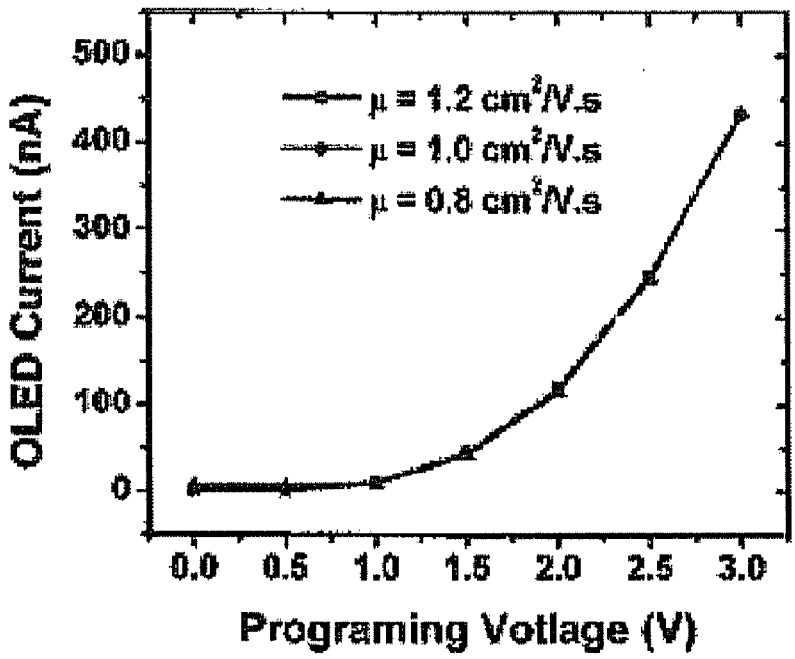
FIG. 7B illustrates further simulation results for the pixel circuit of FIG. 6A.

Referring to FIGS. 7A-7B, there are illustrated graphs showing simulation results for the pixel circuit of FIG. 6A using the operation of FIG. 6B. In FIG. 7A, "ΔVT" represents variation of driving transistor threshold $V_T$, and "μ" represents mobility ($cm^2N\cdot s$). As shown in FIGS. 7A-7B, despite variation in the driving transistor threshold $V_T$ and mobility, the pixel current is stable for all gray scales.

Referring to FIGS. 8-16, there are illustrated examples of CBVP pixel circuits, which may form the pixel arrays of FIGS. 2-5. In FIGS. 8-16, a current bias line ("Ibias" or "IBIAS") provides a bias current to the corresponding pixel. The capacitive driver 10 of FIG. 1 may provide a constant bias current to the current bias line. Examples of the CBVP pixels, display systems and operations are disclosed in US Patent Application Publication US2006/0125408 and PCT International Application Publication WO2009/127065, which are hereby incorporated by reference.

Figure 8A:
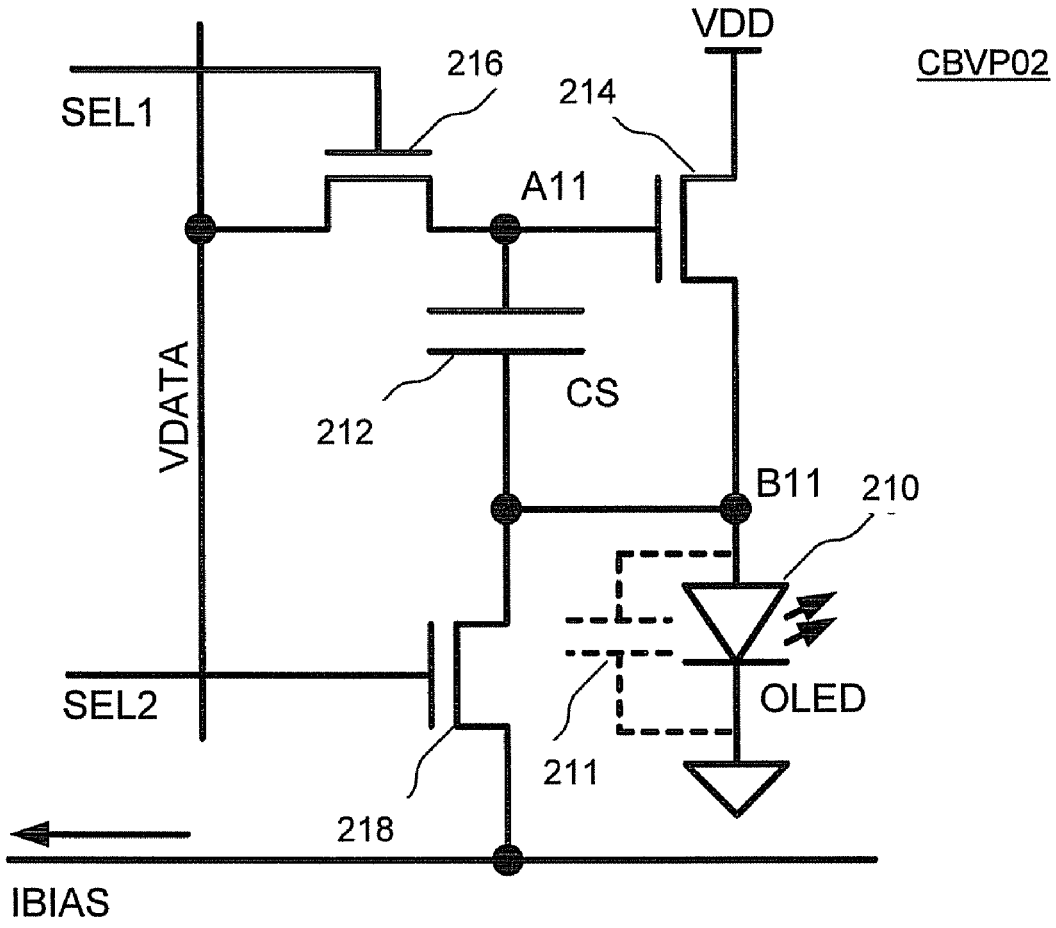
FIG. 8A illustrates a further example of a current biased voltage programmed pixel circuit.

A pixel circuit CBVP02 of FIG. 8A includes an OLED 210, a storage capacitor 212, a driving transistor 214, and switch transistors 216 and 218. The transistors 214, 216 and 218 are n-type TFT transistors. One of ordinary skill in the art would appreciate a circuit that is complementary to the pixel circuit CBVP02 and has p-type transistors. Two select lines SEL1 and SEL2, a signal line VDATA, a bias line IBIAS, a voltage supply line VDD, and a common ground are coupled to the pixel circuit CBVP02. In FIG. 8A, the common ground is for the OLED top electrode. The common ground is not a part of the pixel circuit, and is formed at the final stage when the OLED 210 is formed. The transistors 214 and 216 and the storage capacitor 212 are connected to node A11. The OLED 210, the storage capacitor 212 and the transistors 214 and 218 are connected to node B11.

The gate terminal of the driving transistor 214 is connected to the signal line VDATA through the switch transistor 216 and the capacitor 212. One of the first and second terminals of the driving transistor 214 is connected to the voltage supply line VDD, and the other is connected to the anode electrode of the OLED 210 at B11. The storage capacitor 212 is connected between the gate terminal of the driving transistor 214 at A11 and the OLED 210 at B11. The gate terminal of the switch transistor 216 is connected to the first select line SEL1. One of the first and second terminals of the switch transistor 216 is connected to the signal line VDATA, and the other is connected to the gate terminal of the driving transistor 214 at A11. The gate terminal of the switch transistor 218 is connected to the second select line SEL2. One of the first and second terminals of the switch transistor 218 is connected to the anode electrode of the OLED 210 and the storage capacitor 212 at B11, and the other is connected to the bias line IBIAS. The cathode electrode of the OLED 210 is connected to the common ground.

The operation of the pixel circuit CBVP02 includes a programming phase having a plurality of programming cycles, and a driving phase having one driving cycle. During the programming phase, node B11 is charged to negative of the threshold voltage of the driving transistor 214, and node A11 is charged to a programming voltage VP.

As a result, the gate-source voltage of the driving transistor 214 is:

$$VGS=VP-(-VT)=VP+VT \tag{1}$$

where VGS represents the gate-source voltage of the driving transistor 214, and VT represents the threshold voltage of the driving transistor 214. This voltage remains on the capacitor 212 in the driving phase, resulting in the flow of the desired current through the OLED) 210 in the driving phase.

Figure 8B:
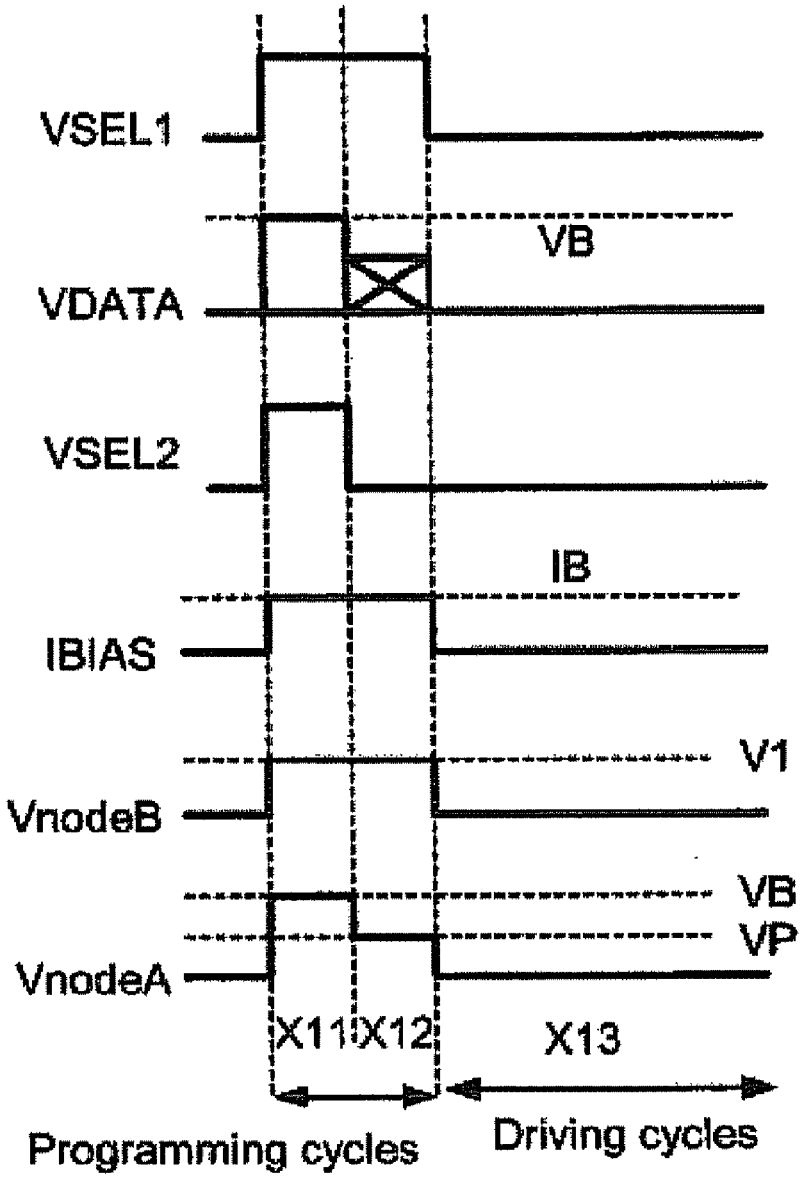
FIG. 8B illustrates an example of a timing diagram for the pixel circuit of FIG. 8A.

Referring to FIG. 8B, there is illustrated one exemplary operation process applied to the pixel circuit CBVP02 of FIG. 8A. In FIG. 8B, "VnodeB" represents voltage at node B11 of FIG. 8A, "VnodeA" represents voltage at node A11 of FIG. 8A, "VSEL1" corresponds to SEL1 of FIG. 8A, and "VSEL2" corresponds to SEL2 of FIG. 8A. The programming phase has two operation cycles X11, X12, and the driving phase has one operation cycle X13.

The first operation cycle X11: Both select lines SEL1 and SEL2 are high. A bias current IB flows through the bias line IBIAS, and VDATA goes to a bias voltage VB.

As a result, the voltage of node B11 is:

$$V\text{node}B = VB - \sqrt{\frac{IB}{\beta}} - VT \tag{2}$$

where VnodeB represents the voltage of node B11, VT represents the threshold voltage of the driving transistor 214, and □β□ represents the coefficient in current-voltage (I-V) characteristics of the TFT given by IDS=β(VGS−VT)$^2$. IDS represents the drain-source current of the driving transistor 214.

The second operation cycle X12: While SEL2 is low, and SEL1 is high, VDATA goes to a programming voltage VP. Because the capacitance 211 of the OLED 210 is large, the voltage of node B11 generated in the previous cycle stays intact.

Therefore, the gate-source voltage of the driving transistor 214 can be found as:

$$VGS = VP + \Delta VB + VT \tag{3}$$

$$\Delta VB = \sqrt{\frac{IB}{\beta}} - VB \tag{4}$$

ΔVB is zero when VB is chosen properly based on (4). The gate-source voltage of the driving transistor 214, i.e., VP+VT, is stored in the storage capacitor 212.

The third operation cycle X13: IBIAS goes to low. SEL1 goes to zero. The voltage stored in the storage capacitor 212 is applied to the gate terminal of the driving transistor 214. The driving transistor 214 is on. The gate-source voltage of the driving transistor 214 develops over the voltage stored in the storage capacitor 212. Thus, the current through the OLED 210 becomes independent of the shifts of the threshold voltage of the driving transistor and OLED characteristics.

Figure 8C:
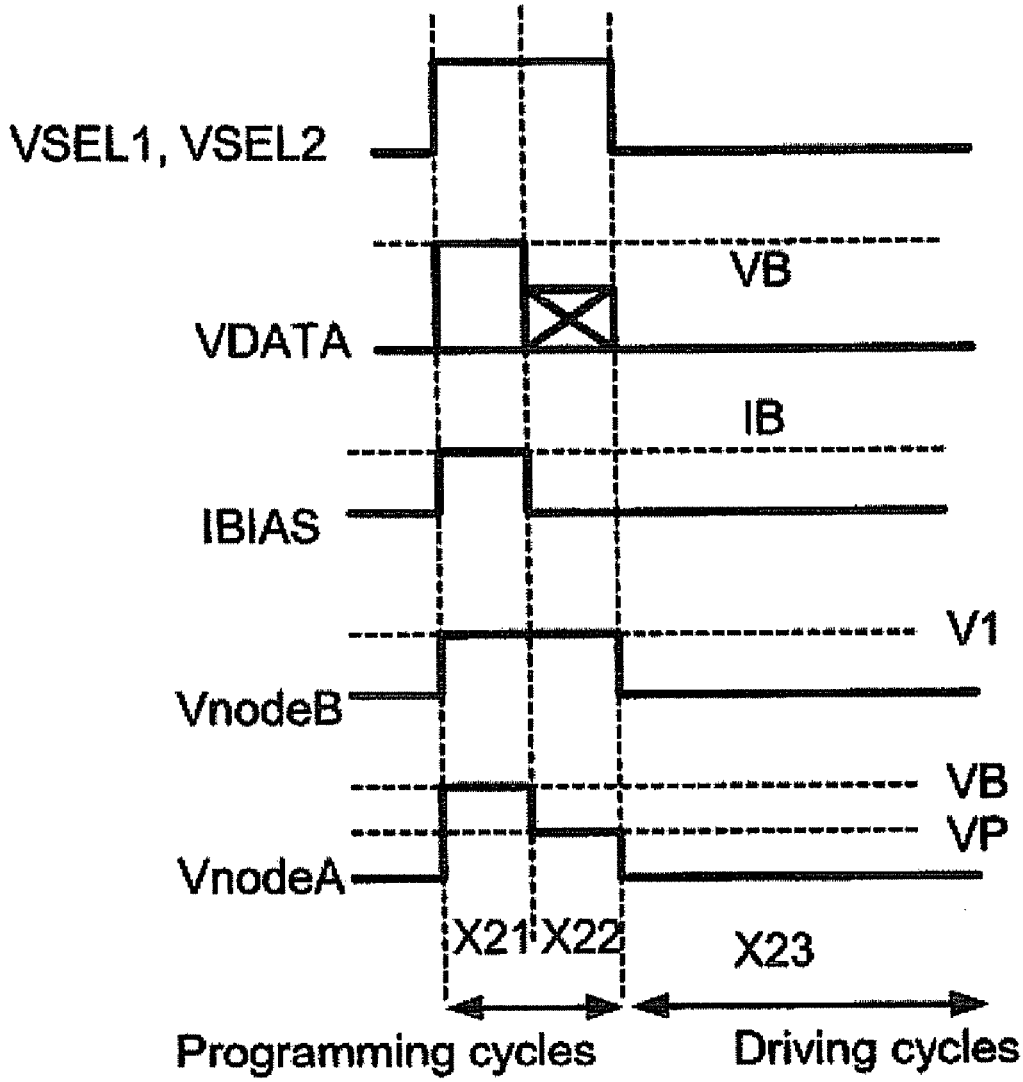
FIG. 8C illustrates another example of a timing diagram for the pixel circuit of FIG. 8A.

Referring to FIG. 8C, there is illustrated a further exemplary operation process applied to the pixel circuit CBVP02 of FIG. 8A. In FIG. 8C, "VnodeB" represents voltage at node B11 of FIG. 8A, "VnodeA" represents voltage at node A11 of FIG. 8A, "VSEL1" corresponds to SEL1 of FIG. 8A, and "VSEL2" corresponds to SEL2 of FIG. 8A. The programming phase has two operation cycles X21, X22, and the driving phase has one operation cycle X23. The first operation cycle X21 is same as the first operation cycle X11 of FIG. 8B. The third operation cycle X23 is same as the third operation cycle X13 of FIG. 8B. In FIG. 8C, the select lines SEL1 and SEL2 have the same timing. Thus, SELL and SEL2 may be connected to a common select line.

The second operating cycle X22: SEL1 and SEL2 are high. The switch transistor 218 is on. The bias current IB flowing through IBIAS is zero.

The gate-source voltage of the driving transistor 214 can be VGS=VP+VT as described above. The gate-source voltage of the driving transistor 214, i.e., VP+VT, is stored in the storage capacitor 212.

Figure 9A:
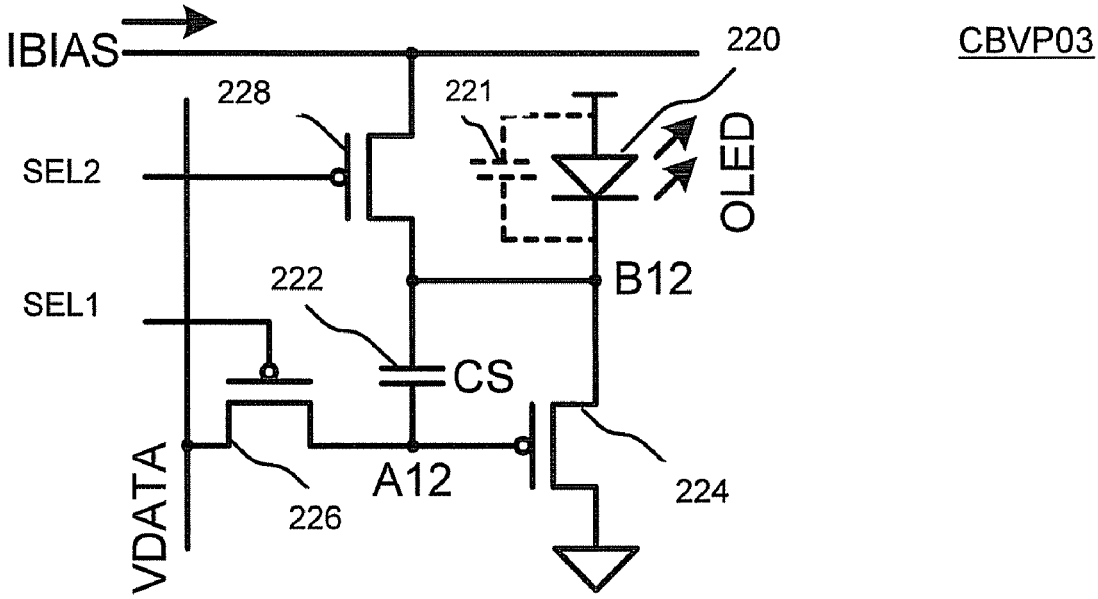
FIG. 9A illustrates a further example of a current biased voltage programmed pixel circuit.

A pixel circuit CBVP03 of FIG. 9A is complementary to the pixel circuit CBVP02 of FIG. 8A, and has p-type transistors. The pixel circuit CBVP03 includes an OLED 220, a storage capacitor 222, a driving transistor 224, and switch transistors 226 and 228. The transistors 224, 226 and 228 are p-type transistors. Two select lines SEL1 and SEL2, a signal line VDATA, a bias line IBIAS, a voltage supply line VDD, and a common ground are coupled to the pixel circuit CBVP03.

The transistors 224 and 226 and the storage capacitor 222 are connected at A12. The cathode electrode of the OLED 220, the storage capacitor 222 and the transistors 224 and 228 are connected at B12. Since the OLED cathode is connected to the other elements of the pixel circuit CBVP03, this ensures integration with any OLED fabrication.

Figure 9B:
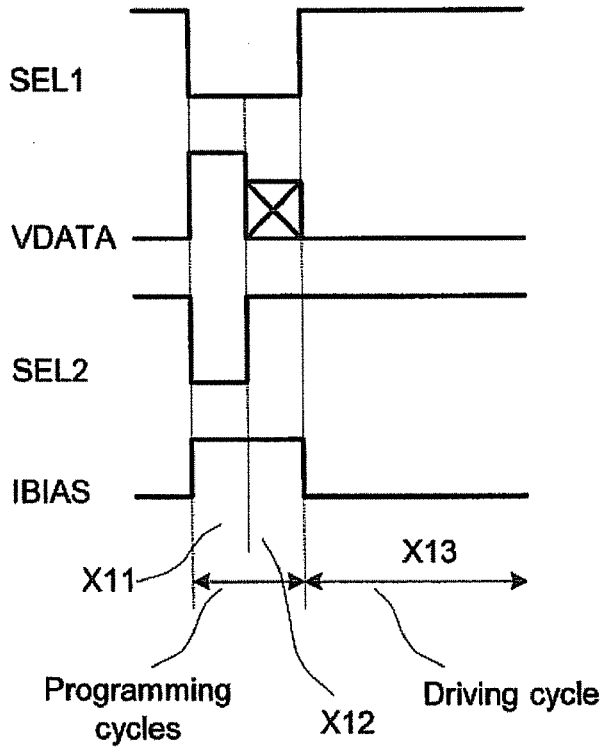
FIG. 9B illustrates an example of a timing diagram for the pixel circuit of FIG. 9A.
Figure 9C:
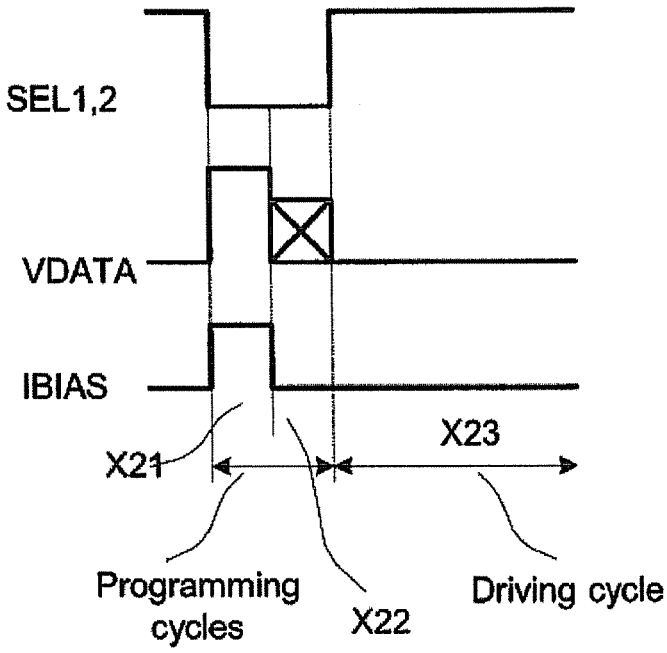
FIG. 9C illustrates another example of a timing diagram for the pixel circuit of FIG. 9A.

Referring to FIGS. 9B-9C, there are illustrated exemplary operation processes applied to the pixel circuit CBVP03 of FIG. 9A. FIG. 9B corresponds to FIG. 8B. FIG. 9C corresponds to FIG. 8C. The CBVP driving schemes of FIGS. 9B-9C use IBIAS and VDATA similar to those of FIGS. 8B-8C.

Figure 10A:
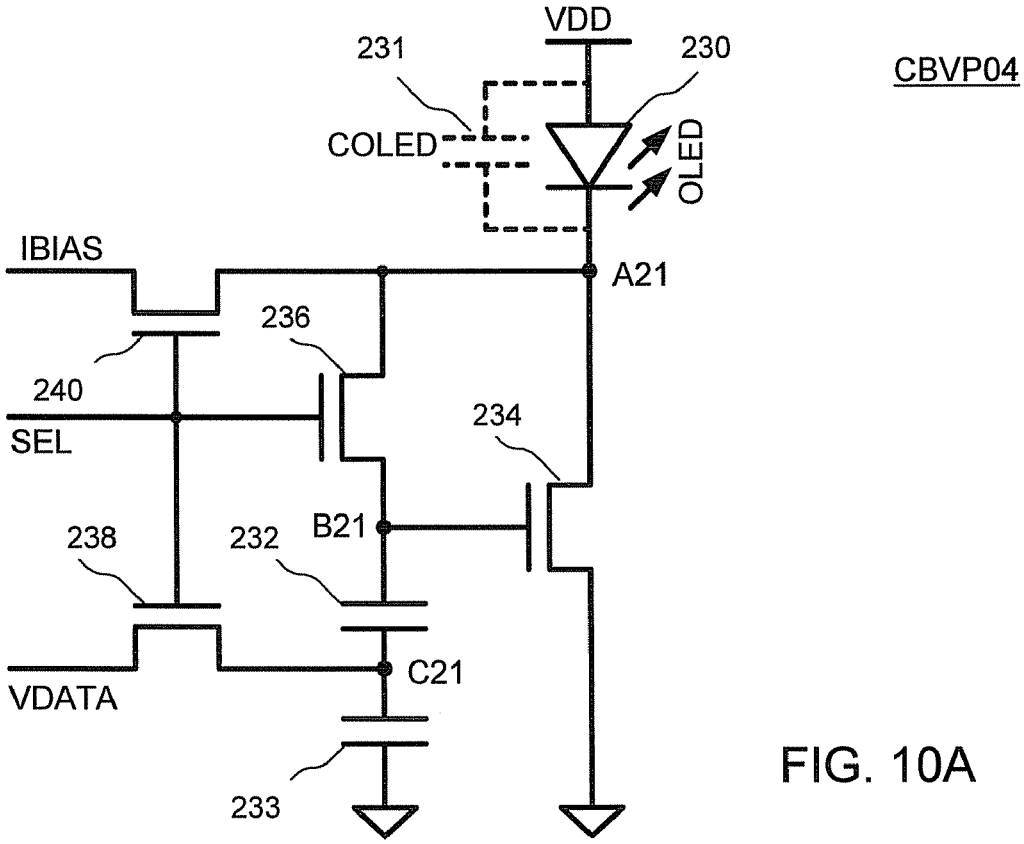
FIG. 10A illustrates a further example of a current biased voltage programmed pixel circuit.

A pixel circuit CBVP04 of FIG. 10A includes an OLED 230, storage capacitors 232 and 233, a driving transistor 234, and switch transistors 236, 238 and 240. The transistors, 234, 236, 238 and 240 are n-type TFT transistors. One of ordinary skill in the art would appreciate a circuit that is complementary to the pixel circuit CBVP04 and has p-type transistors. A select line SEL, a signal line VDATA, a bias line IBIAS, a voltage line VDD, and a common ground are coupled to the pixel circuit CBVP04. The OLED 230, the transistors 234, 236 and 240 are connected at node A21. The storage capacitor 232 and the transistors 234 and 236 are connected at node B21.

One of the first and second terminals of the driving transistor 234 is connected to the cathode electrode of the OLED 230 at A21, and the other is connected to a ground potential. The storage capacitors 232 and 233 are in series and connected between the gate of the driving transistor 234 at B21 and the ground. The gate terminals of the switch transistors 236, 238 and 240 are connected to the select line SEL. One of the first and second terminals of the switch transistor 236 is connected to the OLED 230 and the driving transistor 234 at A21, and the other is connected to the gate terminal of the driving transistor 234 at B21. One of the first and second terminals of the switch transistor 238 is connected to the signal line VDATA, and the other is connected to C21 connecting the storage capacitors 232 and 233. One of the first and second terminals of the switch transistor 240 is connected to the bias line IBIAS, and the other is connected to the cathode terminal of the OLED 230 as A21. The anode electrode of the OLED 230 is connected to the VDD.

The operation of the pixel circuit CBVP04 includes a programming phase having a plurality of programming cycles, and a driving phase having one driving cycle. During the programming phase, the first storage capacitor 232 is charged to a programming voltage VP plus the threshold voltage of the driving transistor 234, and the second storage capacitor 233 is charged to zero.

As a result, the gate-source voltage of the driving transistor 234 is:

$$VGS=VP+VT \tag{5}$$

where VGS represents the gate-source voltage of the driving transistor 234, and VT represents the threshold voltage of the driving transistor 234.

Figure 10B:
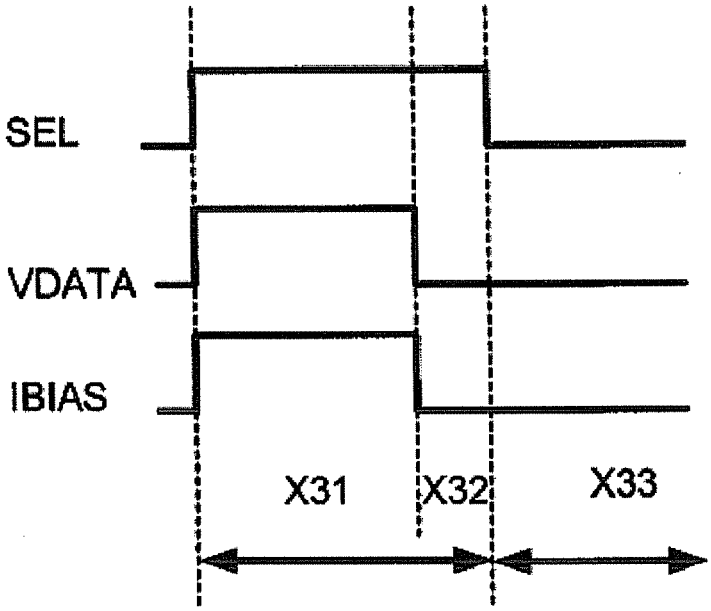
FIG. 10B illustrates an example of a timing diagram for the pixel circuit of FIG. 10A.

Referring to FIG. 10B, there is illustrated one exemplary operation process applied to the pixel circuit CBVP04 of FIG. 10A. The programming phase has two operation cycles X31, X32, and the driving phase has one operation cycle X33.

The first operation cycle X31: The select line SEL is high. A bias current IB flows through the bias line IBIAS, and VDATA goes to a VB−VP where VP is and programming voltage and VB is given by:

$$VB=\sqrt{\frac{IB}{\beta}} \tag{6}$$

As a result, the voltage stored in the first capacitor 232 is:

$$VC1=VP+VT \tag{7}$$

where VC1 represents voltage stored in the first storage capacitor 232, VT represents the threshold voltage of the driving transistor 234, β represents the coefficient in current-voltage (I-V) characteristics of the TFT given by IDS=β(VGS−VT)$^2$. IDS represents the drain-source current of the driving transistor 234.

The second operation cycle X32: While SEL is high, VDATA is zero, and IBIAS goes to zero. Because the capacitance 231 of the OLED 230 and the parasitic capacitance of the bias line IBIAS are large, the voltage at node B21 and the voltage at node A21 generated in the previous cycle stay unchanged.

Therefore, the gate-source voltage of the driving transistor 234 can be found as:

$$VGS=VP+VT \tag{8}$$

where VGS represents the gate-source voltage of the driving transistor 234. The gate-source voltage of the driving transistor 234 is stored in the storage capacitor 232.

The third operation cycle X33: IBIAS goes to zero. SEL goes to zero. The voltage of node C21 goes to zero. The voltage stored in the storage capacitor 232 is applied to the gate terminal of the driving transistor 234. The gate-source voltage of the driving transistor 234 develops over the voltage stored in the storage capacitor 232. Considering that the current of driving transistor 234 is mainly defined by its gate-source voltage, the current through the OLED 230 becomes independent of the shifts of the threshold voltage of the driving transistor 234 and OLED characteristics.

Figure 11A:
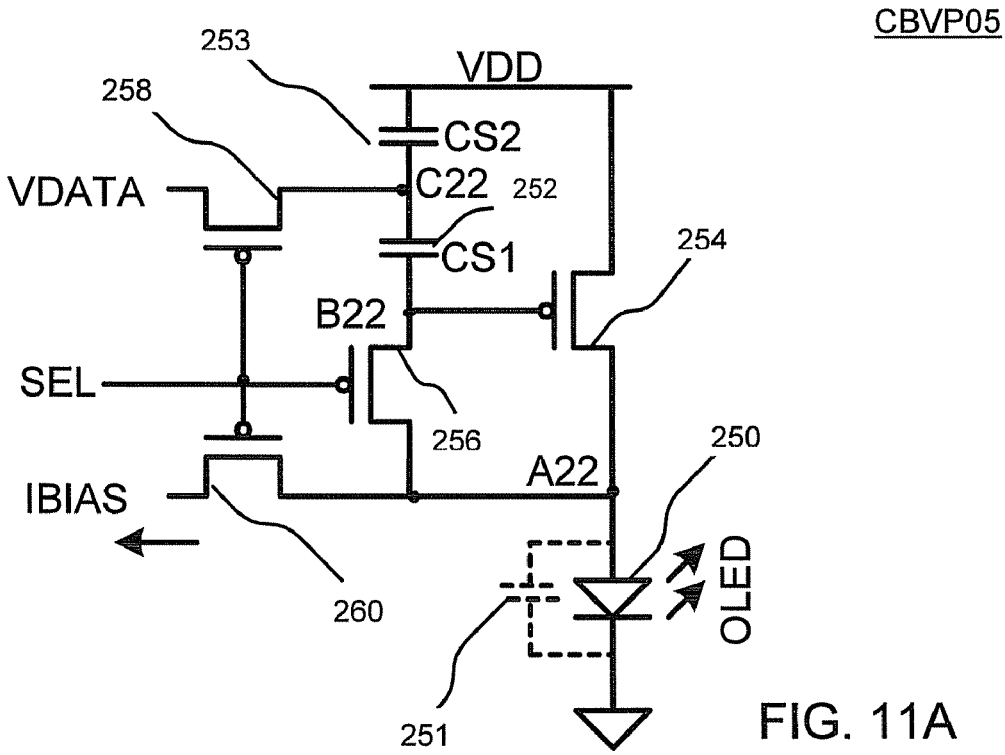
FIG. 11A illustrates a further example of a current biased voltage programmed pixel circuit.

A pixel circuit CBVP05 of FIG. 11A is complementary to the pixel circuit CBVP04 of FIG. 10A, and has p-type transistors. The pixel circuit CBVP05 includes an OLED 250, a storage capacitors 252 and 253, a driving transistor 254, and switch transistors 256, 258 and 260. The transistors 254, 256, 258 and 260 are p-type transistors. Two select lines SEL1 and SEL2, a signal line VDATA, a bias line IBIAS, a voltage supply line VDD, and a common ground are coupled to the pixel circuit CBVP05. The common ground may be same as that of FIG. 8A.

The anode electrode of the OLED 250, the transistors 254, 256 and 260 are connected at node A22. The storage capacitor 252 and the transistors 254 and 256 are connected at node B22. The switch transistor 258, and the storage capacitors 252 and 253 are connected at node C22.

Figure 11B:
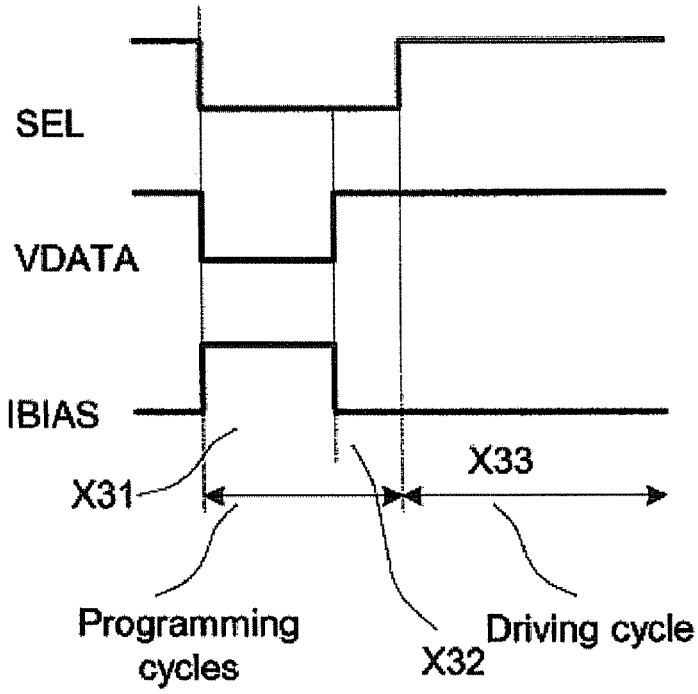
FIG. 11B illustrates an example of a timing diagram for the pixel circuit of FIG. 11A.

Referring to FIG. 11B, there is illustrated one exemplary operation process applied to the pixel circuit CBVP05 of FIG. 11A. FIG. 11B corresponds to FIG. 10B. As shown in FIG. 11B, the CBVP driving scheme of FIG. 11B uses IBIAS and VDATA similar to those of FIG. 10B.

Figure 12A:
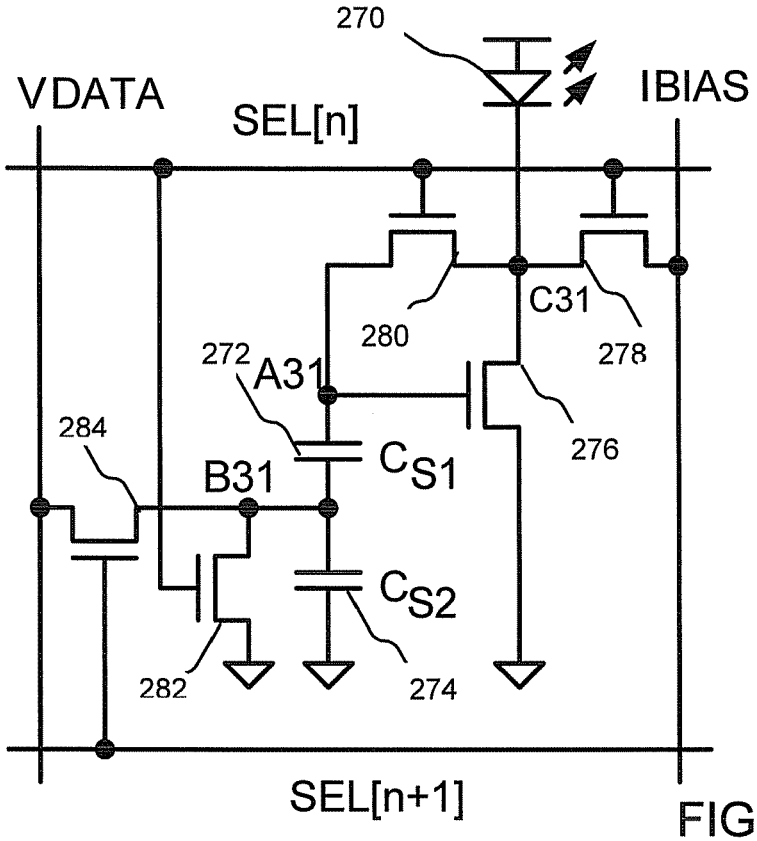
FIG. 12A illustrates an example of a display having a current biased voltage programmed pixel circuit.

A display having a CBVP pixel circuit in FIG. 12A is based on the pixel circuit CBVP04 of FIG. 10A, and includes an OLED 270, storage capacitors 272 and 274, and transistors 276, 278, 280, 282 and 284. The transistor 276 is a driving transistor. The transistors 278, 280 and 284 are switch transistors. The transistors 276 and 280 and the storage capacitor 272 are connected at node A31. The transistors 282 and 284 and the storage capacitors 272 and 274 are connected at B31. The gate terminals of the transistors 278, 280 and 282 are coupled to an address line SEL[n] for the nth row, and the gate terminal of the switch transistor 284 is coupled to an address line SEL[n+1] for the (n+1)th row. The transistors 276, 278, 280, 282 and 284 are n-type TFT transistors. One of ordinary skill in the art would appreciate a circuit that is complementary to the pixel circuit of FIG. 12A and has p-type transistors. One of ordinary skill in the art would appreciate that the driving technique applied to FIG. 12A is applicable to the complementary pixel circuit. In FIG. 12A, elements associated with two rows and one column are shown. The display of FIG. 12A may include more than two rows and more than one column.

Figure 12B:
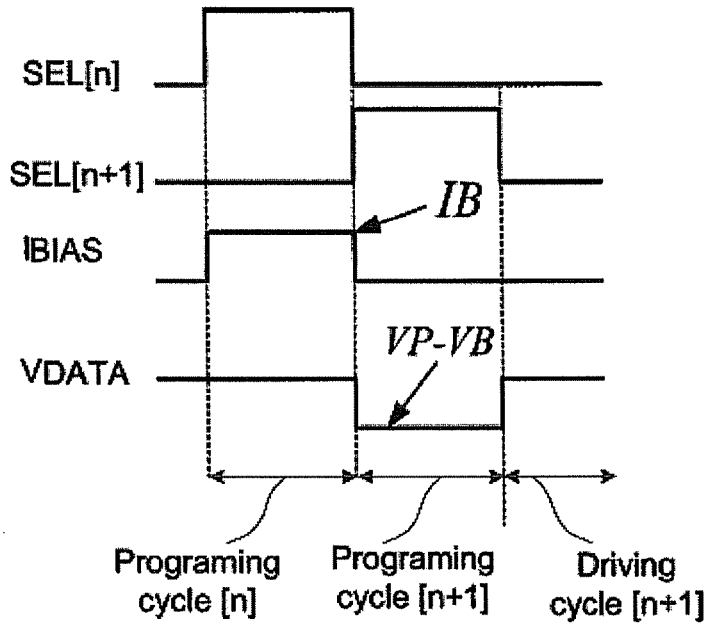
FIG. 12B illustrates an example of a timing diagram for the display of FIG. 12A.

Referring to FIG. 12B, there is illustrated one exemplary operation process applied to the display of FIG. 12A. In FIG. 12B, "Programming cycle [n]" represents a programming cycle for the row. [n] of the display. The programming time is shared between two consecutive rows (n and n+1). During the programming cycle of the nth row, SEL[n] is high, and a bias current IB is flowing through the transistors 278 and 280. The voltage at node A31 is self-adjusted to $(IB/\beta)^{1/2}+VT$, while the voltage at node B31 is zero, where VT represents the threshold voltage of the driving transistor 276, and β represents the coefficient in current-voltage (I-V) characteristics of the TFT given by $IDS=\beta(VGS-VT)^2$, and IDS represents the drain-source current of the driving transistor 276.

During the programming cycle of the (n+1)th row, VDATA changes to VP−VB. As a result, the voltage at node A31 changes to VP+VT if $VB=(IB/\beta)^{1/2}$. Since a constant current is adopted for all the pixels, the IBIAS line consistently has the appropriate voltage so that there is no necessity to pre-charge the line, resulting in shorter programming time and lower power consumption. More importantly, the voltage of node B31 changes from VP−VB to zero at the beginning of the programming cycle of the nth row. Therefore, the voltage at node A31 changes to $(IB/\beta)^{1/2}+VT$, and it is already adjusted to its final value, leading to a fast settling time.

Figure 13A:
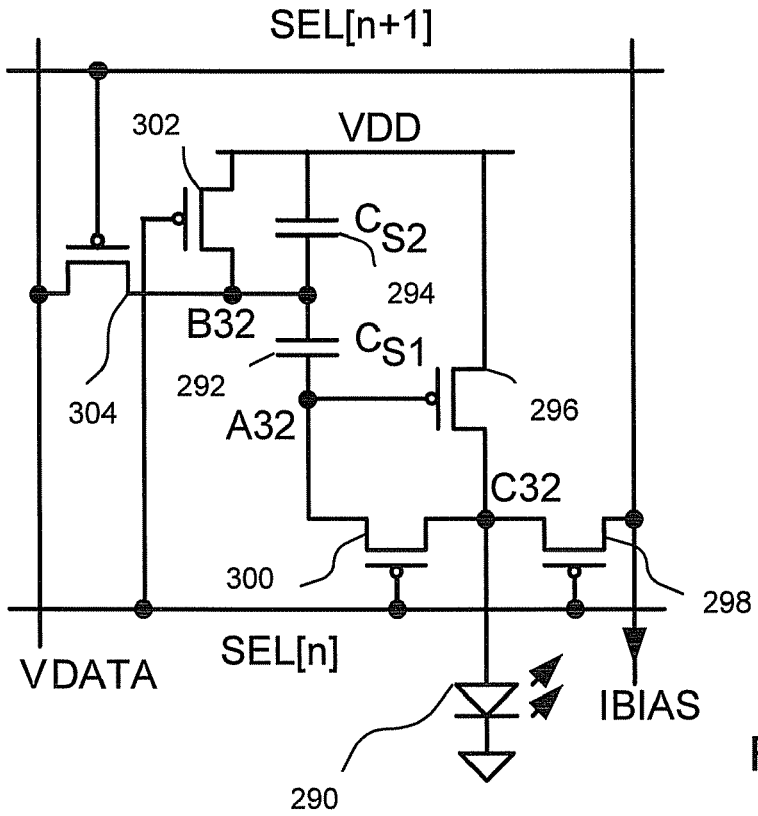
FIG. 13A illustrates an example of a display having a current biased voltage programmed pixel circuit.

A display having a CBVP pixel circuit in FIG. 13A is based on the pixel circuit CBVP05 of FIG. 11, and has OLED 290, a storage capacitors 292 and 294, and p-type TFT transistors 296, 298, 300, 302 and 304. The transistor 296 is a driving transistor. The transistors 298, 300 and 304 are switch transistors. The transistors 296 and 300 and the storage capacitor 292 are connected at node A32. The transistors 302 and 304 and the storage capacitors 292 and 294 are connected at B32. The transistors 296, 298 and 200 and the OLED 290 are connected at C32. The gate terminals of the transistors 298, 300 and 302 are coupled to an address line SEL[n] for the nth row, and the gate terminal of the switch transistor 304 is coupled to an address line SEL[n+1] for the (n+1)th row. One of ordinary skill in the art would appreciate a circuit that is complementary to the pixel circuit of FIG. 13A and has n-type transistors. One of ordinary skill in the art would appreciate that the driving technique applied to FIG. 13A is applicable to the complementary pixel circuit. In FIG. 13A, elements associated with two rows and one column are shown. The display of FIG. 13A may include more than two rows and more than one column. The driving transistor 296 is connected between the anode electrode of the OLED 290 and a voltage supply line VDD.

Figure 13B:
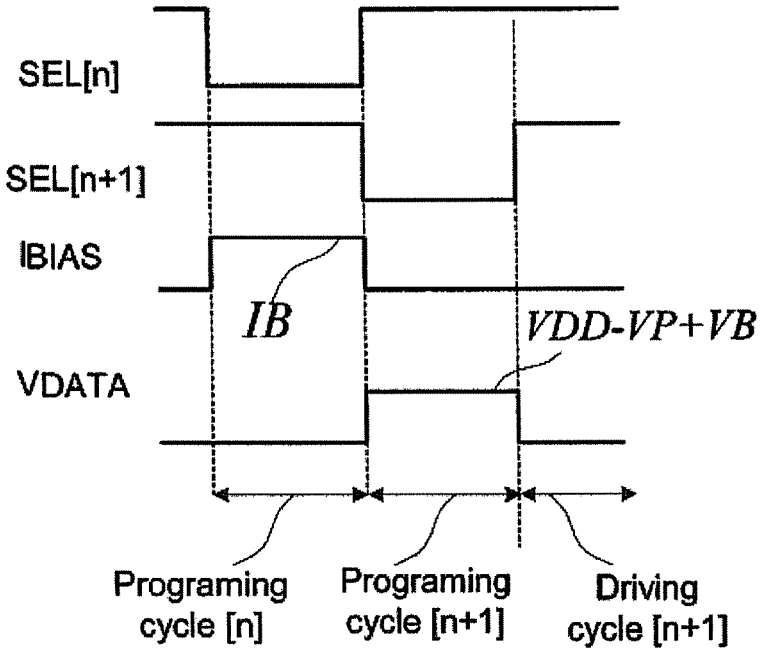
FIG. 13B illustrates an example of a timing diagram for the display of FIG. 13A.

Referring to FIG. 13B, there is illustrated one exemplary operation process applied to the display of FIG. 13A. FIG. 13B corresponds to FIG. 12B. The CBVP driving scheme of FIG. 13B uses IBIAS and VDATA similar to those of FIG. 12B.

Figure 14A:
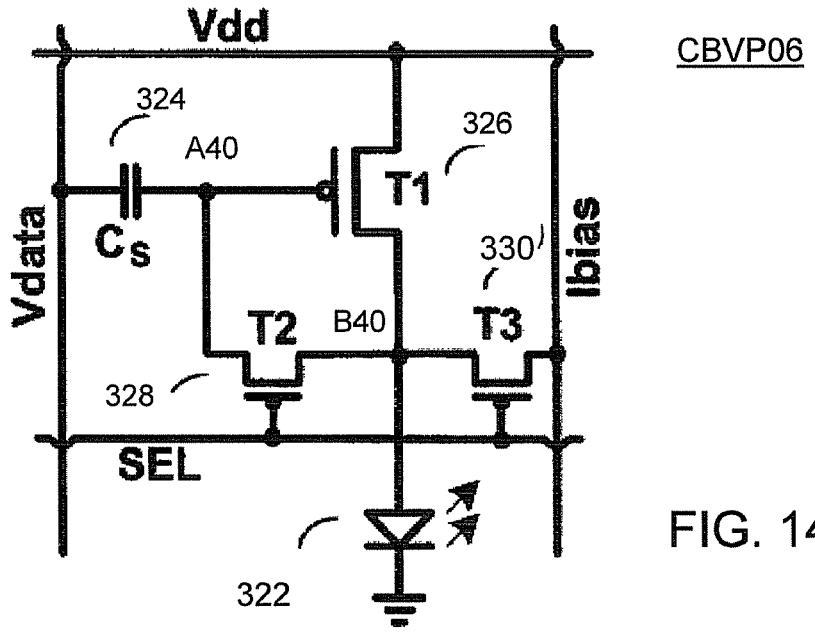
FIG. 14A illustrates a further example of a current biased voltage programmed pixel circuit.

A pixel circuit CBVP06 of FIG. 14A includes an OLED 322, a storage capacitor 324, a driving transistor 326, and switch transistors 328 and 330. The transistors 326, 328 and 330 are p-type TFT transistors. One of ordinary skill in the art would appreciate a circuit that is complementary to the pixel circuit of FIG. 14A and has n-type transistors. One of ordinary skill in the art would appreciate that the driving technique applied to FIG. 14A is applicable to the complementary pixel circuit. A select line SEL, a signal line Vdata, a bias line Ibias, and a voltage supply line Vdd are connected to the pixel circuit CBVP06. The bias line Ibias provides a bias current (Ibias) that is defined based on display specifications, such as lifetime, power, and device performance and uniformity.

One of the first and second terminals of the driving transistor 326 is connected to the voltage supply line Vdd, and the other is connected to the OLED 322 at node B40. One terminal of the capacitor 324 is connected to the signal line Vdata, and the other terminal is connected to the gate terminal of the driving transistor 326 at node A40. The gate terminals of the switch transistors 328 and 330 are connected to the select line SEL. The switch transistor 328 is connected between A40 and B40. The switch transistor 330 is connected between B40 and the bias line Ibias. In the pixel circuit CBVP06, a predetermined fixed current (Ibias) is provided through the transistor 330 to compensate for all spatial and temporal non-uniformities and voltage programming is used to divide the current in different current levels required for different gray scales.

Figure 14B:
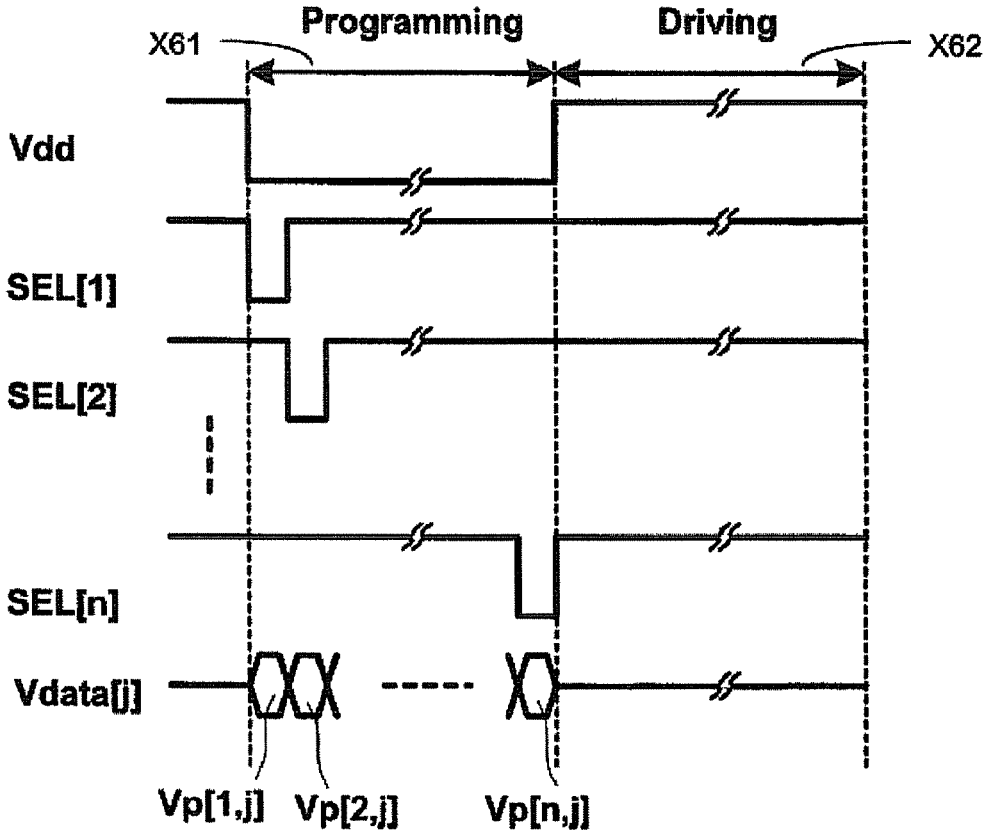
FIG. 14B illustrates an example of a timing diagram for the pixel circuit of FIG. 14A.

Referring to FIG. 14B, there is illustrated one exemplary operation process applied to the pixel circuit CBVP06 of FIG. 14A. The operation process includes a programming phase X61 and a driving phase X62. Vdata [j] in FIG. 14B corresponds to Vdata of FIG. 14A. Vp[kj] in FIG. 14B (k=1, 2, . . . , n) represents the kth programming voltage on Vdata [j] where "j" is the column number. SEL[j] in FIG. 14B (j=1, 2, . . . ) represents a select line ("SEL" in FIG. 14A) for the jth column.

During the programming cycle X61, SEL is low so that the switch transistors 328 and 330 are on. The bias current Ibias is applied via the bias line Ibias to the pixel circuit CBVP06, and the gate terminal of the driving transistor 326 is self-adjusted to allow all the current passes through source-drain of the driving transistor 326. At this cycle, Vdata has a programming voltage related to the gray scale of the pixel. During the driving cycle X62, the switch transistors 328 and 330 are off, and the current passes through the driving transistor 326 and the OLED 322.

Figure 15A:
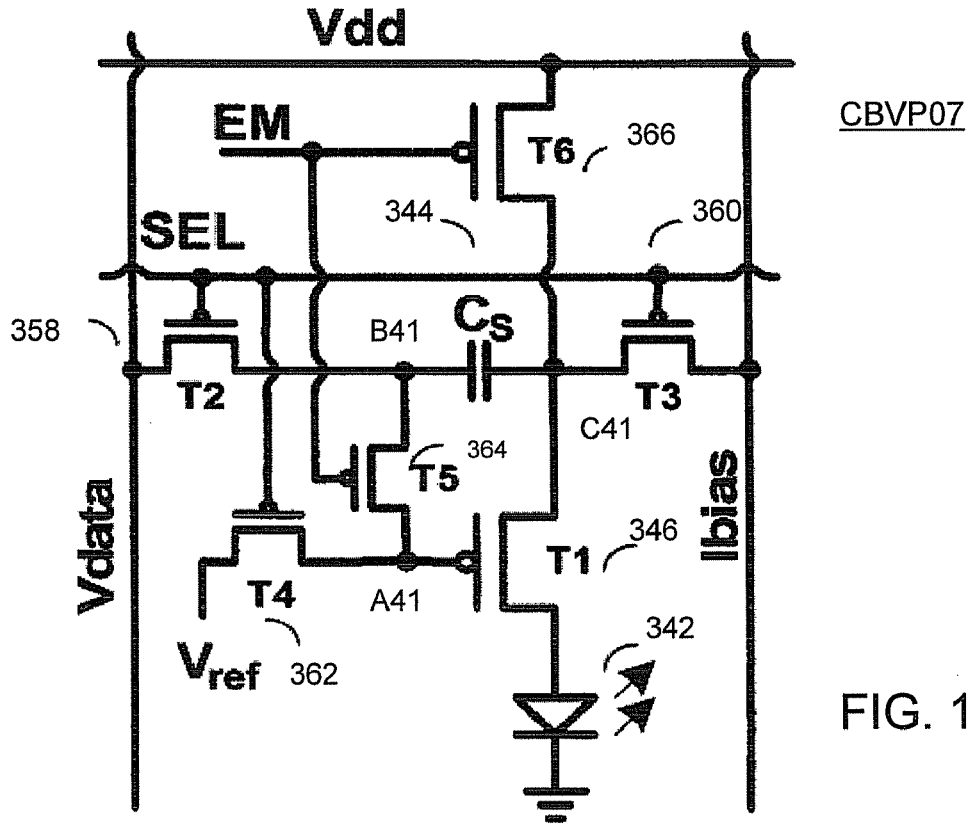
FIG. 15A illustrates a further example of a current biased voltage programmed pixel circuit.

A pixel circuit CBVP07 of FIG. 15A includes an OLED 342, a storage capacitor 344, and transistors 346, 358, 360, 362, 364, and 366. The transistors 346, 358, 360, 362, 364, and 366 are p-type TFT transistors. One of ordinary skill in the art would appreciate a circuit that is complementary to the pixel circuit of FIG. 15A and has n-type transistors. One of ordinary skill in the art would appreciate that the driving technique applied to FIG. 15A is applicable to the complementary pixel circuit. One select line SEL, a signal line Vdata, a bias line Ibias, a voltage supply line Vdd, a reference voltage line Vref, and an emission signal line EM are connected to the pixel circuit CBVP07. The bias line Ibias provides a bias current (Ibias) that is defined based on display specifications, such as lifetime, power, and device performance and uniformity. The reference voltage line Vref provides a reference voltage (Vref). The reference voltage Vref may be determined based on the bias current Ibias and the display specifications that may include gray scale and/or contrast ratio. The signal line EM provides an emission signal EM that turns on the pixel circuit CBVP07. The pixel circuit CBVP07 goes to emission mode based on the emission signal EM. The select line SEL is connected to the gate terminals of the transistors 358, 360 and 362. The select line EM is connected to the gate terminals of the transistors 364 and 366. The transistor 346 is a driving transistor. The transistors 358, 360, 362, 364, and 366 are switching transistors.

One of the first and second terminals of the transistor 362 is connected to the reference voltage line Vref, and the other is connected to the gate terminal of the transistor 346 at node A41. One of the first and second terminals of the transistor 364 is connected to A41 and the other is connected to the capacitor 344 at B41. One of the first and second terminals of the transistor 358 is connected to Vdata and the other is connected to B41. One of the first and second terminals of the transistor 366 is connected to Vdd and the other is connected to the capacitor 344 and the transistor 346 at C41. One of the first and second terminals of the transistor 360 is connected to Ibias and the other is connected to the capacitor 344 and the transistor 346 at C41. One of the first and second terminals of the transistor 346 is connected to OLED 342 and the other is connected to the capacitor 344 and the transistors 366 and 360 at C41.

In the pixel circuit CBVP07, a predetermined fixed current (Ibias) is provided through the transistor 360 while the reference voltage Vref is applied to the gate terminal of the transistor 346 through the transistor 362 and a programming voltage VP is applied to the other terminal of the storage capacitor 344 (i.e., node B41) through the transistor 358. Here, the source voltage of the transistor 346 (i.e., voltage of node C41) will be self-adjusted to allow the bias current goes through the transistor 346 and thus it compensates for all spatial and temporal non-uniformities. Also, voltage programming is used to divide the current in different current levels required for different gray scales.

Figure 15B:
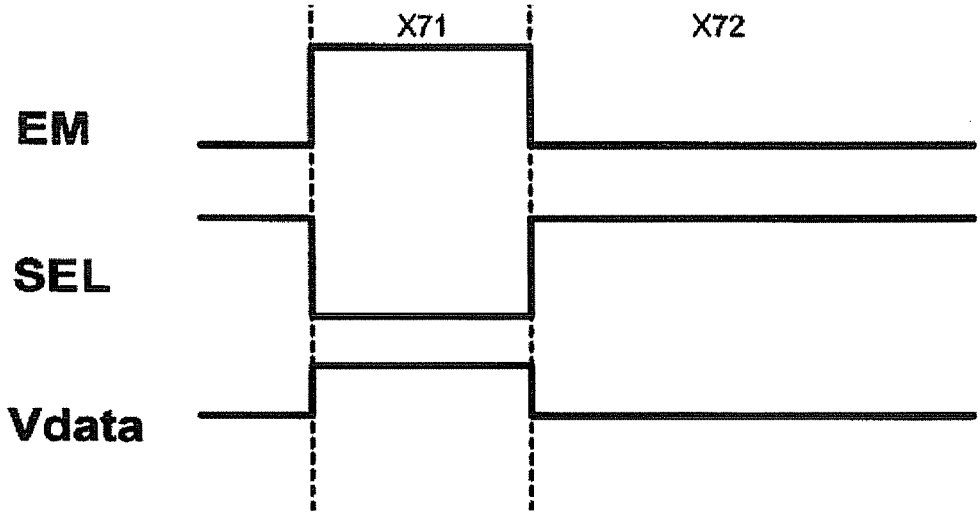
FIG. 15B illustrates an example of a timing diagram for the pixel circuit of FIG. 15A.

Referring to FIG. 15B, there is illustrated one exemplary operation process applied to the pixel circuit CBVP07 of FIG. 15A. The operation process includes a programming phase X71 and a driving phase X72. During the programming cycle X71, SEL is low so that the transistors 358, 360 and 362 are on, a fixed bias current is applied to Ibias line, and the source of the transistor 346 is self-adjusted to allow all the current passes through source-drain of the transistor 346. At this cycle, Vdata has a programming voltage related to the gray scale of the pixel and the capacitor 344 stores the programming voltage and the voltage generated by current for mismatch compensation. During the driving cycle X72, the transistors 358, 360 and 362 are off, while the transistors 364 and 366 are on by the emission signal EM. During this driving cycle X72, the transistor 346 provides current for the OLED 342.

In FIG. 14B, the entire display is programmed, then it is light up (goes to emission mode). By contrast, in FIG. 15B, each row can light up after programming by using the emission line EM.

In the above examples of FIGS. 8-15, the capacitor of each pixel may act as the storage capacitor and the driving capacitor 14 of FIG. 1. In the above examples, the capacitive current source 10 of FIG. 1 is used to provide a constant current to the bias current line. In another example, the capacitive current source 10 may adjust the bias current during the operation of the display.

Figure 16:
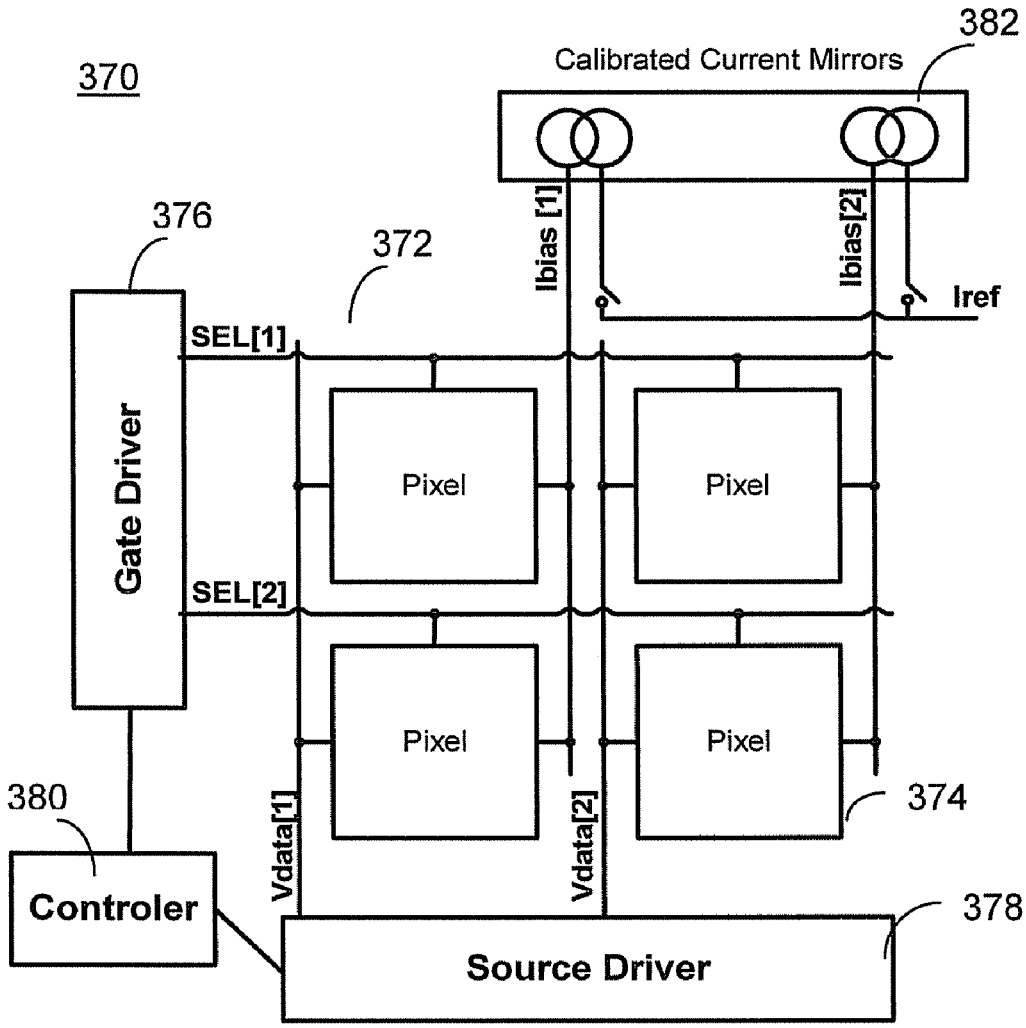
FIG. 16 illustrates a further example of a display system having the current biased voltage programmed pixel circuit.

Referring to FIG. 16, there is illustrated a further example of a display system having array structure for implementation of the CBVP driving scheme. The display system 370 of FIG. 16 includes a pixel array 372 having a plurality of pixels 374, a gate driver 376, a source driver 378, and a controller 380. The controller 380 is provided to control and schedule programming, calibration, driving and other operations for the display array 372, which include the CBVP driving scheme and the capacitive driving as described above. The controller 380 controls the drivers 376 and 378. The pixel circuit 374 is a current biased voltage programmed pixel (e.g., of FIGS. 8-15) where SEL [i] (i=1, 2, . . . ) is a select (address) line (e.g., SEL), Vdata (j=1, 2, . . . ) is a signal (data) line (e.g., Vdata, VDATA), and Ibias [j] (j=1, 2, . . . ) is a bias line (e.g., Ibias, IBIAS). The gate driver 376 operates on the address (select) lines (e.g., SEL [1], SEL[2], . . . ). The source driver 378 operates on the data lines (e.g., Vdata [1], Vdata [2], . . . ). When using the pixel circuit CBVP07 of FIG. 15A as the pixel circuit 374, a driver at the peripheral of the display, such as the gate driver 376, controls each emission line EM.

The display system 370 includes a calibrated current mirrors block 382 for operating on the bias lines (e.g., Ibias [1], Ibias [2]) using a reference current Iref. The block 382 includes a plurality of calibrated current mirrors, each for the corresponding Ibias. The reference current Iref may be provided to the calibrated current mirrors block 382 through a switch.

In FIG. 16, the current mirrors are calibrated with a reference current source. During the programming cycle of the panel (e.g., X61 of FIG. 14B, X71 of FIG. 15B), the calibrated current mirrors (block 382) provide current to the bias line Ibias. These current mirrors can be fabricated at the edge of the panel. The capacitive driver 10 of FIG. 1 may generate the reference current Iref in FIG. 16.

The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits. Since the settling time of the pixel circuits described above is much smaller than conventional pixel circuits, it is suitable for large-area display such as high definition TV, but it also does not preclude smaller display areas either.

Figure 18A:
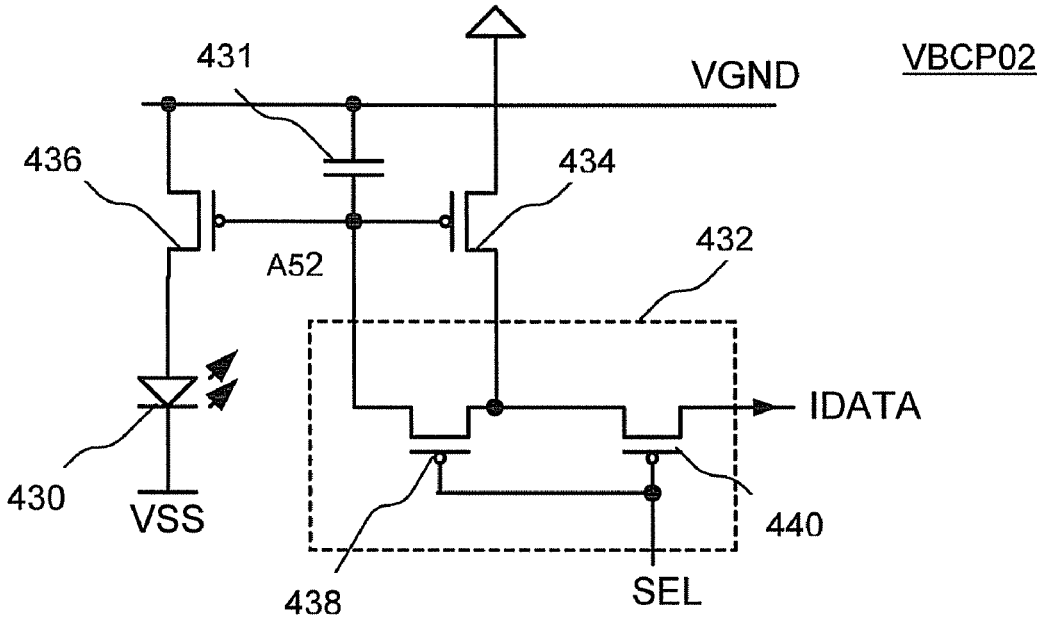
FIG. 18A illustrates a further example of a voltage biased current programmed pixel circuit.
Figure 18B:
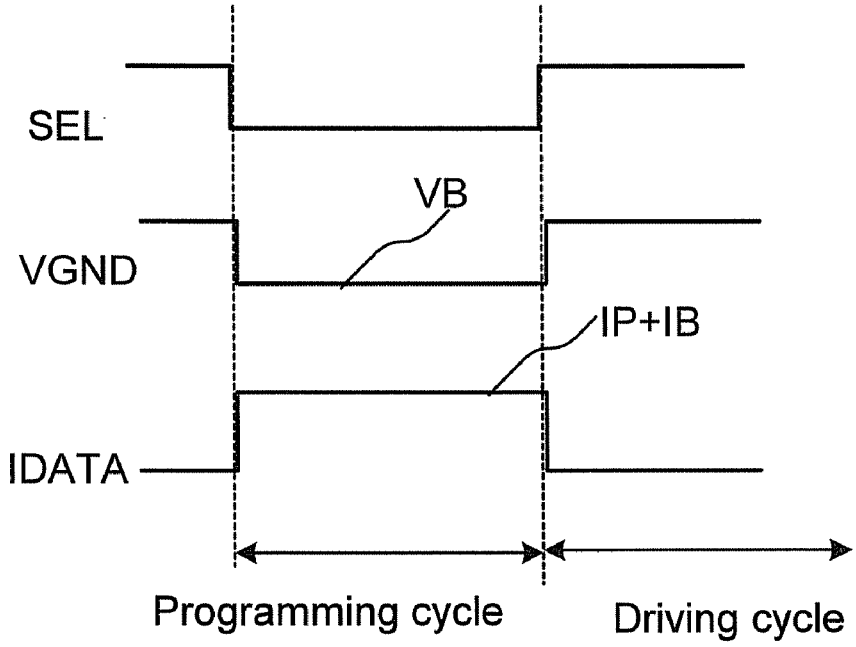
FIG. 18B illustrates an example of a timing diagram for the pixel circuit of FIG. 18A.
Figure 19:
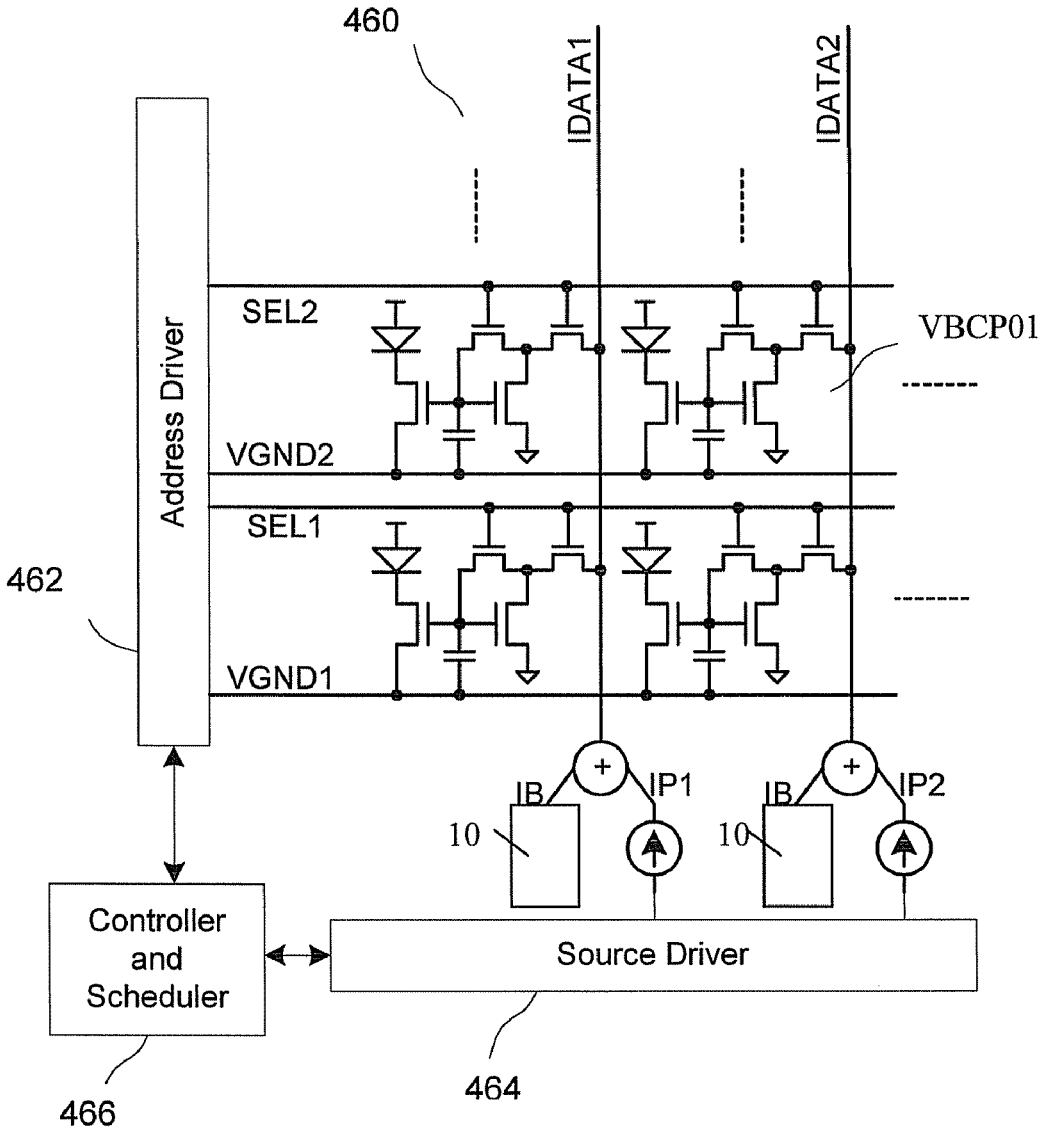
FIG. 19 illustrates an example of a display system having the voltage biased current programmed pixel circuit.

Referring to FIGS. 17-19, there are illustrated examples of VBCP pixel circuits, which may form the pixel arrays of FIG. 2-5. Examples of the VBCP pixels, their display systems and operations are disclosed in US Patent Application Publication US2006/0125408 and PCT International Application Publication WO2009/127065, which are hereby incorporated by reference.

In the VBCP driving scheme, a pixel current is scaled down without resizing mirror transistors. The VBCP driving scheme uses current to provide for different gray scales (current programming), and uses a bias to accelerate the programming and compensate for a time dependent parameter of a pixel, such as a threshold voltage shift. One of the terminals of a driving transistor is connected to a virtual ground VGND. By changing the voltage of the virtual ground, the pixel current is changed. A bias current IB is added to a programming current IP at a driver side, and then the bias current is removed from the programming current inside the pixel circuit by changing the voltage of the virtual ground. A driver for driving a display array having the VBCP pixel circuit converts pixel luminance data into current.

The capacitive driving technique is applicable to the VBCP display to further improve the settling time suitable for larger and higher resolution displays. In FIGS. 17-19, a data line IDATA provides the programming current IP and the bias current IB to the corresponding pixel where the capacitive driver 10 of FIG. 1 is used, for example, to provide the bias current IB.

Figure 17A:
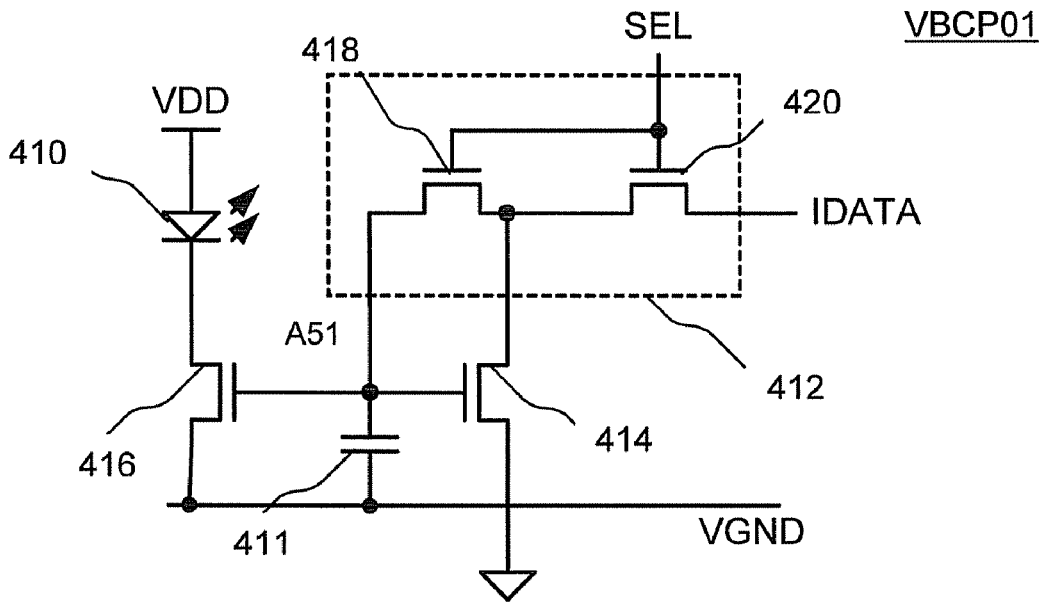
FIG. 17A illustrates an example of a voltage biased current programmed pixel circuit.

A pixel circuit VBCP01 of FIG. 17A includes an OLED 410, a storage capacitor 411, a switch network 412, and mirror transistors 414 and 416. The mirror transistors 414 and 416 form a current mirror where the transistor 414 is a programming transistor and the transistor 416 is a driving transistor. The switch network 412 includes switch transistors 418 and 420. The transistors 414, 416, 418 and 420 are n-type TFT transistors. One of ordinary skill in the art would appreciate a circuit that is complementary to the pixel circuit VBCP01 and has p-type transistors. A select line SEL, a signal line IDATA, a virtual grand line VGND, a voltage supply line VDD, and a common ground are connected to the pixel circuit VBCP01.

One of the first and second terminals of the transistor 416 is connected to the cathode electrode of the OLED 410 and the other is connected to the VGND. The gate terminal of the transistor 414, the gate terminal of the transistor 416, and the storage capacitor 411 are connected at node A51. The gate terminals of the switch transistors 418 and 420 are connected to the SEL. One of the first and second terminals of the switch transistor 418 is connected to the gate terminal of the transistor 416 at A51 and the other is connected to the transistor 414. One of the first and second terminals of the switch transistor 420 is connected to the IDATA and the other is connected to the transistor 414.

Figure 17B:
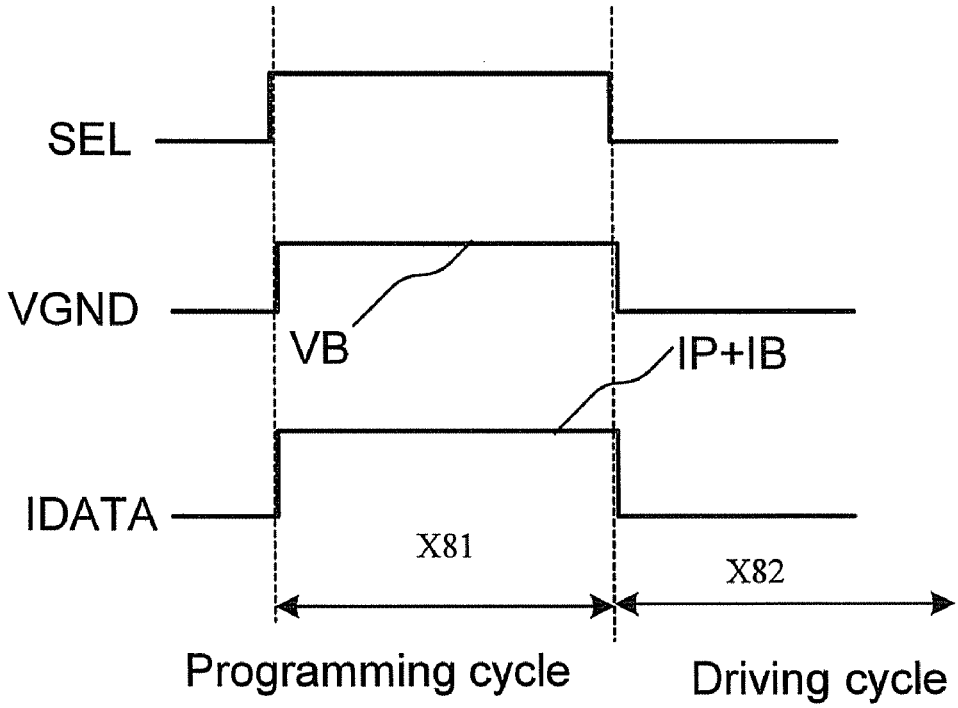
FIG. 17B illustrates an example of a timing diagram for the pixel circuit of FIG. 17A.

Referring to FIG. 17B, there is illustrated an exemplary operation for the pixel circuit VBCP01 of FIG. 17A. Referring to FIGS. 17A and 17B, current scaling technique applied to the pixel circuit VBCP01 is described in detail. The operation of the pixel circuit VBCP01 has a programming cycle X81 and a driving cycle X82.

The programming cycle X81: SEL is high. Thus, the switch transistors 418 and 420 are on. The VGND goes to a bias voltage VB. A current (IB+IP) is provided through the IDATA, where IP represents a programming current, and IB represents a bias current. A current equal to (IB+IP) passes through the switch transistors 418 and 420.

The gate-source voltage of the driving transistor 416 is self-adjusted to:

$$VGS = \sqrt{\frac{IP + IB}{\beta}} + VT \tag{9}$$

where VT represents the threshold voltage of the driving transistor 416, and β represents the coefficient in current-voltage (I-V) characteristics of the TFT given by $IDS=\beta(VGS-VT)^2$. IDS represents the drain-source current of the driving transistor 416.

The voltage stored in the storage capacitor 411 is:

$$VCS = \sqrt{\frac{IP + IB}{\beta}} - VB + VT \tag{10}$$

where VCS represents the voltage stored in the storage capacitor 411.

Since one terminal of the driving transistor 416 is connected to the VGND, the current flowing through the OLED 410 during the programming time is:

$$Ipixel = IP + IB + \beta\cdot(VB)^2 - 2\sqrt{\beta}\cdot VB\cdot\sqrt{(IP+IB)} \tag{11}$$

where Ipixel represents the pixel current flowing through the OLED 410.

If IB>>IP, the pixel current Ipixel can be written as:

$$Ipixel = IP + (IB + \beta\cdot(VB)^2 - 2\sqrt{\beta}\cdot VB\cdot\sqrt{IB}) \tag{12}$$

VB is chosen properly as follows:

$$VB = \sqrt{\frac{IB}{\beta}} \tag{13}$$

The pixel current Ipixel becomes equal to the programming current IP. Therefore, it avoids unwanted emission during the programming cycle. Since resizing is not required, a better matching between two mirror transistors in the current-mirror pixel circuit can be achieved.

A pixel circuit VBCP02 of FIG. 18A is complementary to the pixel circuit VBCP01 of FIG. 17A, and has p-type transistors. The pixel circuit VBCP02 employs the VBCP driving scheme as shown FIG. 18B. The pixel circuit VBCP02 includes an OLED 430, a storage capacitor 431, a switch network 432, and mirror transistors 434 and 436. The mirror transistors 434 and 436 form a current mirror where the transistor 434 is a programming transistor and the transistor 436 is a driving transistor. The switch network 432 includes switch transistors 438 and 440. The transistors 434, 436, 438 and 440 are p-type TFT transistors. A select line SEL, a signal line IDATA, a virtual grand line VGND, and a voltage supply line VSS are provided to the pixel circuit VBCP02.

One of the first and second terminals of the transistor 436 is connected to the VGND and the other is connected to the cathode electrode of the OLED 430. The gate terminal of the transistor 434, the gate terminal of the transistor 436, the storage capacitor 431 and the switch network 432 are connected at node A52.

Referring to FIG. 18B, there is illustrated an exemplary operation for the pixel circuit VBCP02 of FIG. 18A. FIG. 18B corresponds to FIG. 17B. The VBCP driving scheme of FIG. 18B uses IDATA and VGND similar to those of FIG. 17B.

The VBCP technique applied to the pixel circuits VBCP01 and VBCP02 of FIGS. 17A and 18A is applicable to current programmed pixel circuits other than current mirror type pixel circuit.

Referring to FIG. 19, there is illustrated a display system having a plurality of VBCP pixel circuits. The display array 460 of FIG. 19 includes the pixel circuits VBCP01 of FIG. 17A. The display array 460 may include any other pixel circuits to which the VBCP driving scheme described is applicable. In FIG. 19, four VBCP pixel circuits are shown; however, the display array 460 may have more than four or less than four VBCP pixel circuits. "SEL1" and "SEL2" shown in FIG. 19 correspond to SEL, of FIG. 17A. "VGND1" and "VGND2" shown in FIG. 19 correspond to VGND of FIG. 17A. "IDATA1" and "IDATA2" shown in FIG. 19 correspond to IDATA of FIG. 17A.

IDATA1 (or IDATA2) is shared between the common column pixels while SEL1 (or SEL2) and VGND1 (or VGND2) are shared between common row pixels in the array structure. SEL1, SEL2, VGND1 and VGND2 are driven through an address driver 462. IDATA1 and IDATA2 are driven through a source driver 464. A controller and scheduler 466 is provided for controlling and scheduling programming, calibration, driving and other operations for operating the display array, which includes the control and schedule for the VBCP driving scheme and the capacitive driving as described above.

A further technique to develop a high resolution stable low power emissive display is described in detail In the following example in FIGS. 20A-20B and 21A-21B, the capacitive current source 10 of FIG. 1 is used in a driving cycle of a pixel.

Figure 20A:
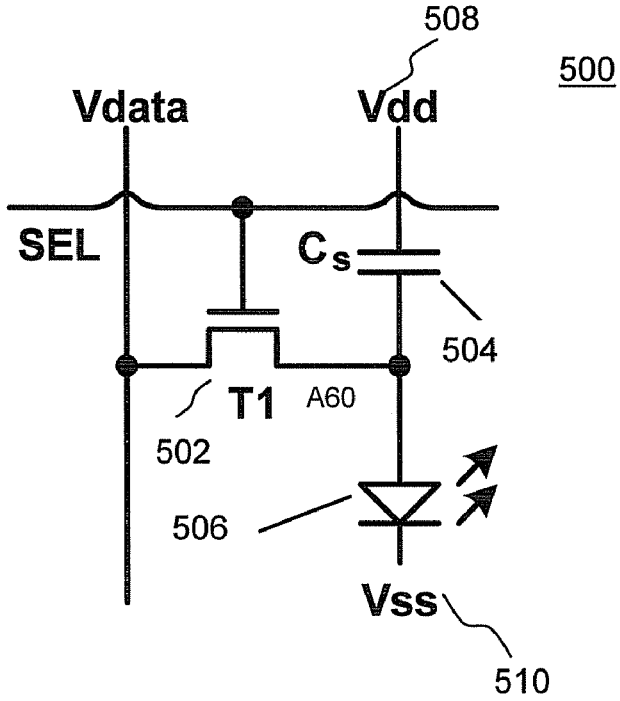
FIG. 20A illustrates an example of a pixel circuit to which the bidirectional current source is applied.

Referring to FIG. 20A, there is illustrated one example of a pixel circuit that can provide constant current over the frame time. The pixel circuit 500 of FIG. 20A includes a single switch transistor (T1) 502, a storage capacitor 504, and an OLED 506. The capacitor 504 is coupled to a power supply Vdd 508. The OLED 506 is coupled to another power supply Vss 510. The gate terminal of the switch transistor 502 is coupled to an address line SEL. One of the first and second terminals of the switch transistor 502 is coupled to a data line Vdata and the other terminal is coupled to the capacitor 504 and the OLED 506 at node A60.

Figure 20B:
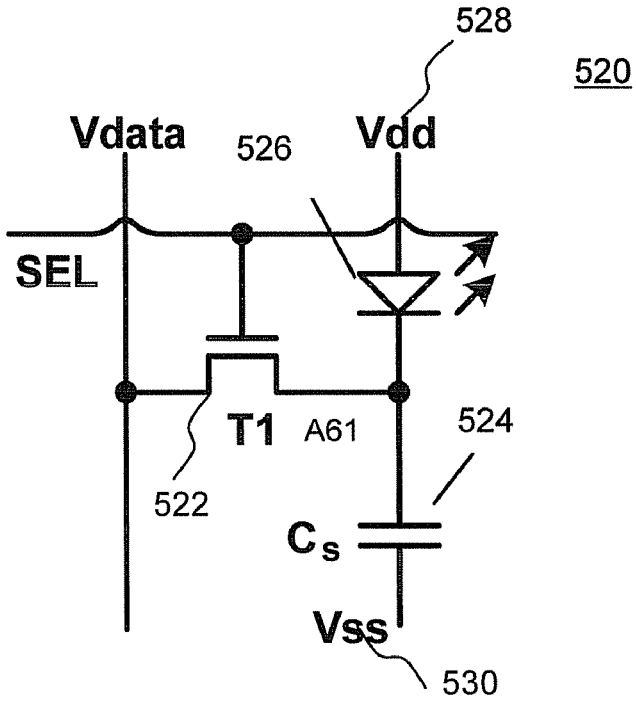
FIG. 20B illustrates another example of a pixel circuit to which the bidirectional current source is applied.

Referring to FIG. 20B, there is illustrated another example of a pixel circuit that can provide constant current over the frame time. The pixel circuit 520 of FIG. 20B includes a switch transistor (T1) 522, a storage capacitor 524, and an OLED 526. The capacitor 524 is coupled to a power supply Vdd 528. The OLED, 526 is coupled to another power supply Vss 530. The gate terminal of the switch transistor 522 is coupled to an address line SEL. One of the first and second terminals of the switch transistor 522 is coupled to a data line Vdata and the other terminal is coupled to the capacitor 524 and the OLED 526 at node A61.

Figure 21A:
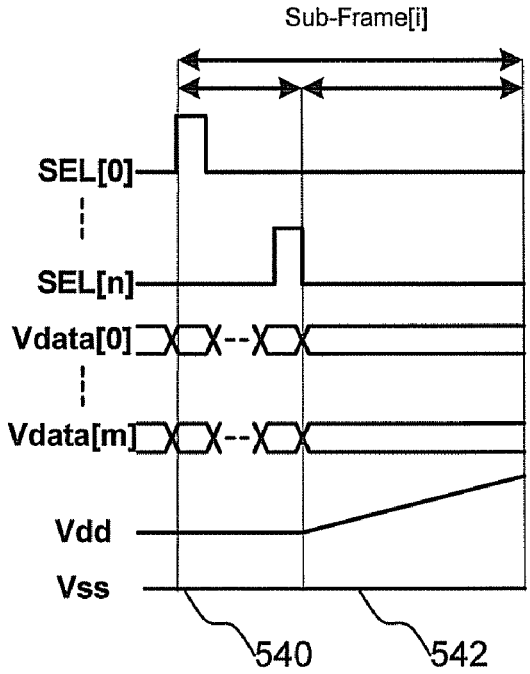
FIG. 21A illustrates an example of a timing diagram for the pixel circuits of FIGS. 20A-20B.

Referring to FIG. 21A, there is illustrated one example of waveforms applied to the pixel circuits of FIGS. 20A-20B. SEL [i] (i=0, n) in FIG. 21A represents an address line for the ith row and corresponds to SEL of FIG. 20A-20B; Vdata [j] (j=0, . . . , m) in FIG. 21A represents a data line for the jth column and corresponds to Vdata of FIGS. 20A-20B; Vdd in FIG. 21A corresponds to Vdd of FIGS. 20A-20B; Vss in FIG. 21A corresponds to Vss of FIGS. 20A-20B. The frame time of FIG. 21A is divided into a programming cycle 540 and a driving cycle 542. During the programming cycle 540, a row is consecutively selected by the address line SEL [i], and the pixels in the selected row are programmed with the programming data Vdata [0]-Vdata [m]. During the programming cycle 540, a connection node between the capacitor and the OLED, e.g., A60, A61, is charged to a programming voltage (Vp) through Vdata, which acts as Iout of FIG. 1.

During the driving cycle 542, the power supply Vdd increases by applying a ramp voltage to the Vdd, for example, from the ramp voltage generator 12 of FIG. 1. A constant current flows via the capacitor (504, 524). As a result, the connection node, e.g., A60, A61, starts to charge up till the OLED turns on. Then a voltage equal to CsVR/τ passes through the OLED where "VR" is the ramp voltage, "τ" the ramp time, and "Cs" represents capacitance for the capacitor (504, 524).

Figure 21B:
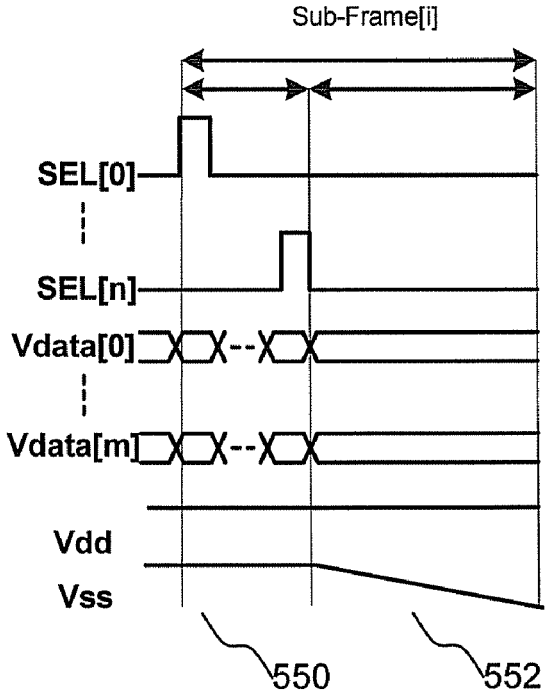
FIG. 21B illustrates another example of a timing diagram for the pixel circuits of FIGS. 20A-20B.

Referring to FIG. 21B, there is illustrated another example of waveforms applied to the pixel circuits of FIGS. 20A-20B. SEL [i] (i=0, n) in FIG. 21B represents an address line for the ith row and corresponds to SEL of FIG. 20A-20B; Vdata [j] (j=0, . . . , m) in FIG. 21B represents a data line for the jth column and corresponds to Vdata of FIGS. 20A-20B; Vdd in FIG. 21B corresponds to Vdd of FIGS. 20A-20B; Vss in FIG. 21B corresponds to Vss of FIGS. 20A-20B. The frame time of FIG. 21B is divided into a programming cycle 550 and a driving cycle 552. During the programming cycle 550, a row is consecutively selected by the address line SEL [i], and the pixels in the selected row are programmed with the programming data Vdata [0]-Vdata [m]. During the programming cycle 550, a connection node between the capacitor and the OLED, e.g., A60, A61, is charged to a programming voltage (Vp) through Vdata, which acts as Iout of FIG. 1

During the driving cycle 552, the power supply Vss decreases by applying a ramp voltage to the Vss, for example, from the ramp voltage generator 12 of FIG. 1. A constant current flows via the capacitor (524, 502). As a result, the connection node, e.g., A61, A60, starts to discharge till the OLED turns on. Then a voltage equal to CsVR/τ passes through the OLED.

As shown in FIGS. 20A, 20B, 21A, and 21B, this technique does not require any more driving cycle or driving circuitry than that used in AMLCD displays, resulting in shorter driving time, lower power consumption, high aperture ration and stability of the display, and thus a lower cost application for portable devices including mobiles and PDAs.

Figure 22:
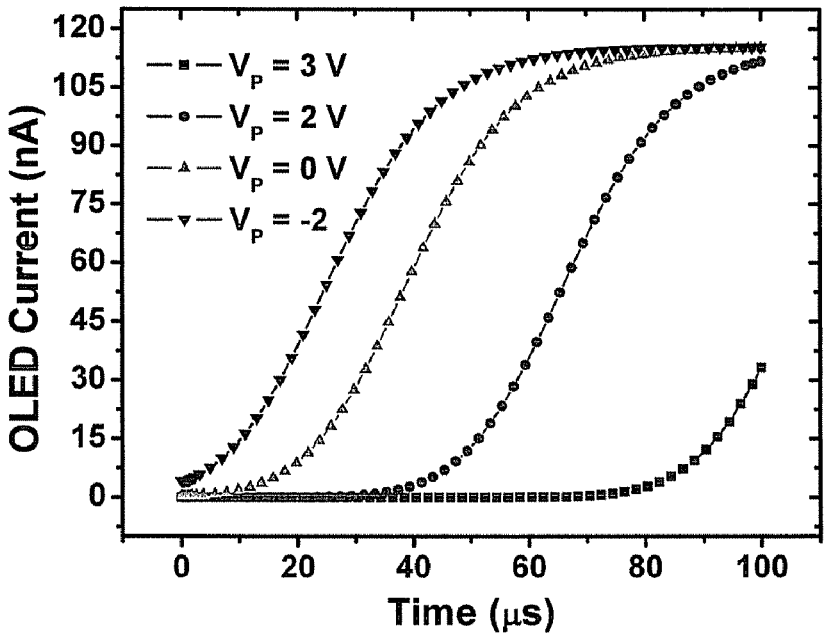
FIG. 22 illustrates a graph showing simulation results (OLED current) for the pixel circuits of FIGS. 20A-20B in one sub-frame for different programming voltages

Referring to FIG. 22, there is a graph showing simulation results (OLED current) for the pixel circuits of FIGS. 20A-20B in one sub-frame for different programming voltages. In FIG. 22, "Vp" represents programming voltage. As shown in FIG. 22, the pixel current is modulated by time as the programming voltage (Vp) changes.

Figure 23:
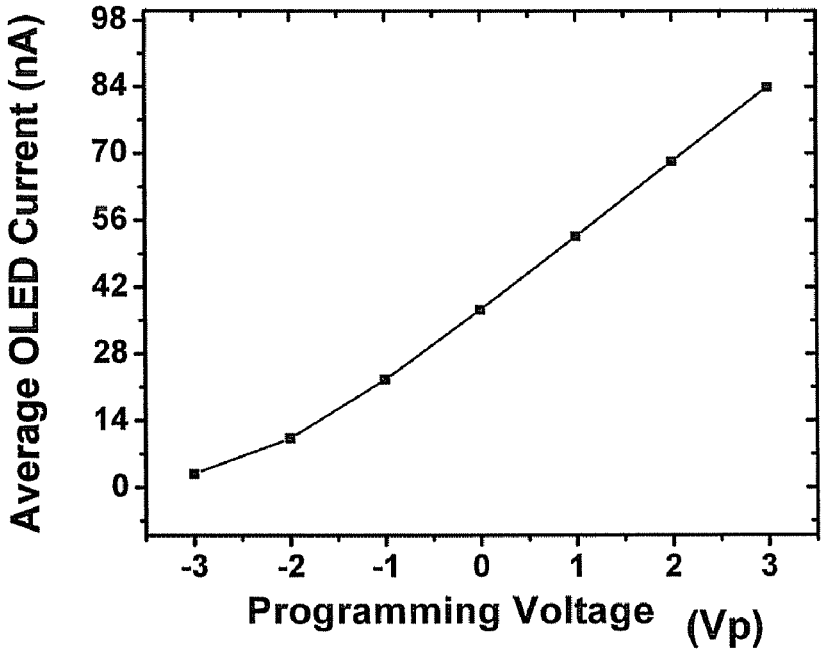
FIG. 23 illustrates a graph showing simulation results (the average current) for the pixel circuits of FIGS. 20A-20B.

Referring to FIG. 23, there is a graph showing simulation results (average OLED current) for the pixel circuits of FIGS. 20A-20B. The graph in FIG. 23 shows the I-V characteristics of the pixel. As shown in FIG. 23, the pixel current is clearly controlled by the programming voltage (Vp).

Figure 24:
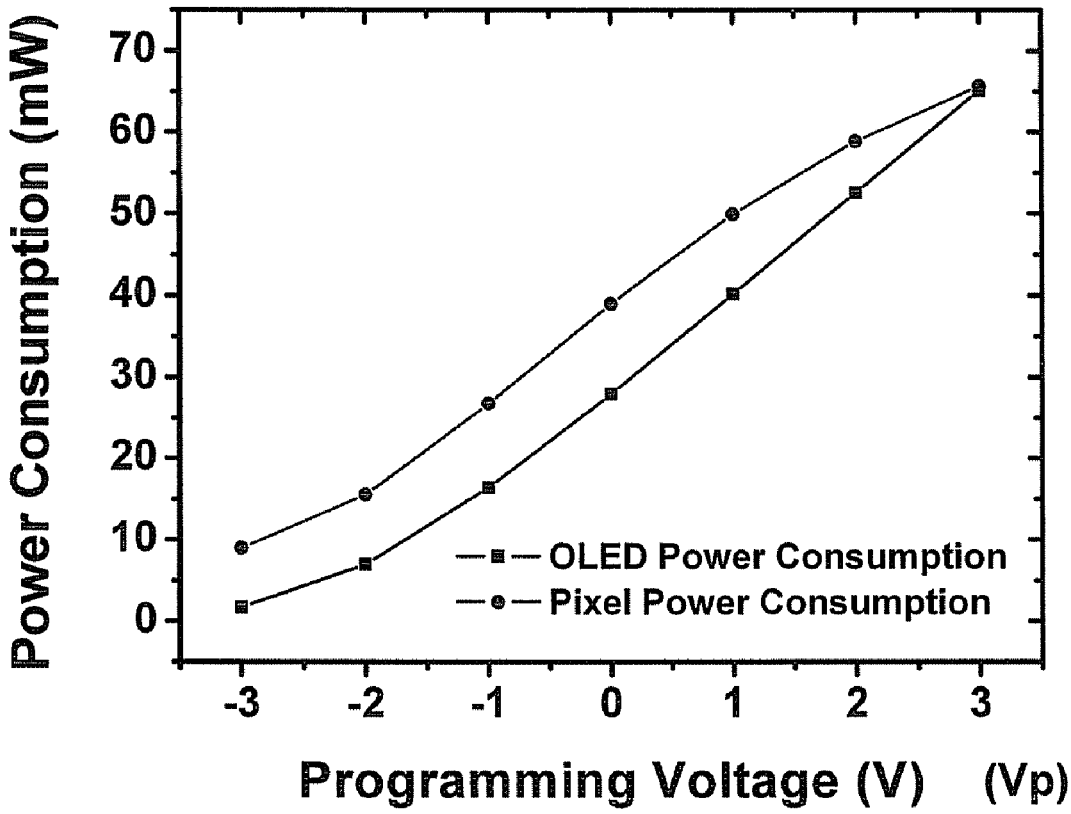
FIG. 24 illustrates a graph showing a power consumption of a 2.2-inch QVGA panel and a power consumption used for the OLED.

Referring to FIG. 24, there is a graph showing a power consumption of a 2.2-inch Quarter Video Graphics Array (QVGA) panel and a power consumption used for the OLED. As shown in FIG. 24, the power consumption of the entire panel is very close to that of the OLED. In particular, since the entire capacitive voltage goes to the OLED (506, 536 of FIGS. 20A-20B), the power consumption approaches that of the OLED power consumption at high current level. Here, adiabatic charge sharing can be used to improve the power consumption of the driver side as well, for example, by sharing the charge between two adjacent rows.

Figure 25:
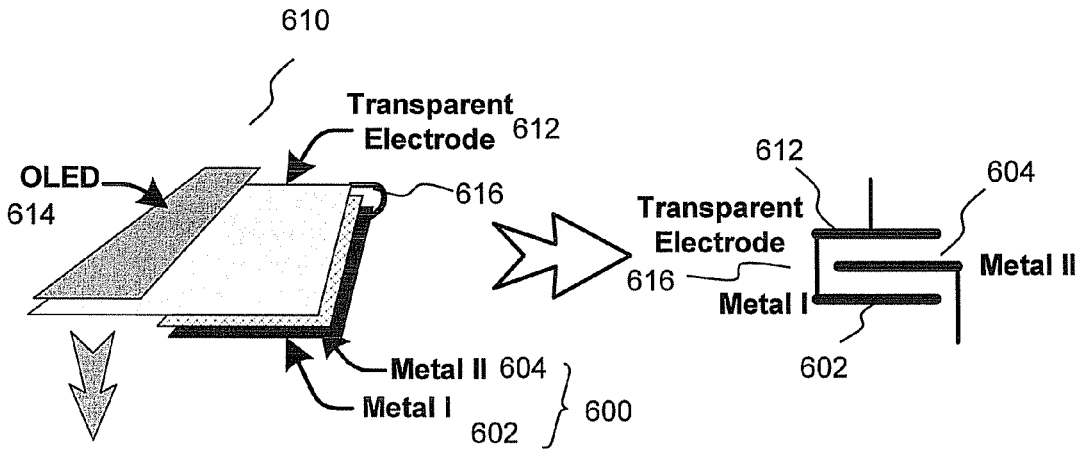
FIG. 25 illustrates an example of the implementation of a capacitor for driving a bottom emission display.

Referring to FIG. 25, there is illustrated an example of the implementation of a large capacitor for driving a bottom emission display. A capacitor 600 shown in FIG. 25 is an inter-digitated capacitor and is usable as the driving capacitor 10 of FIG. 1 and/or a storage capacitor of a pixel circuit. The capacitors 504 and 524 of FIGS. 20A-20B may be the inter-digitated capacitor 600. The inter-digitated capacitor 600 includes a metal I layer 602 and a metal II layer 604. The OLED device 610 is formed on the inter-digitated capacitor 600, which at least has a transparent bottom electrode 612 and an OLED layer 614. The OLED layer 614 is located on the bottom electrode 612. The metal I layer 602 is coupled to the OLED bottom electrode 612 via an interconnection line 616. The metal I layer 602 and the metal II layer 604 are located below the bottom electrode 612, without covering light from the OLED 614. In FIG. 25, the OLED layer 614 is placed on one side of the bottom electrode 612 while the metal layers 602 and 604 are placed under the other side of the bottom electrode 612. This can results in large capacitor without sacrificing the aperture ratio.

Figure 26:
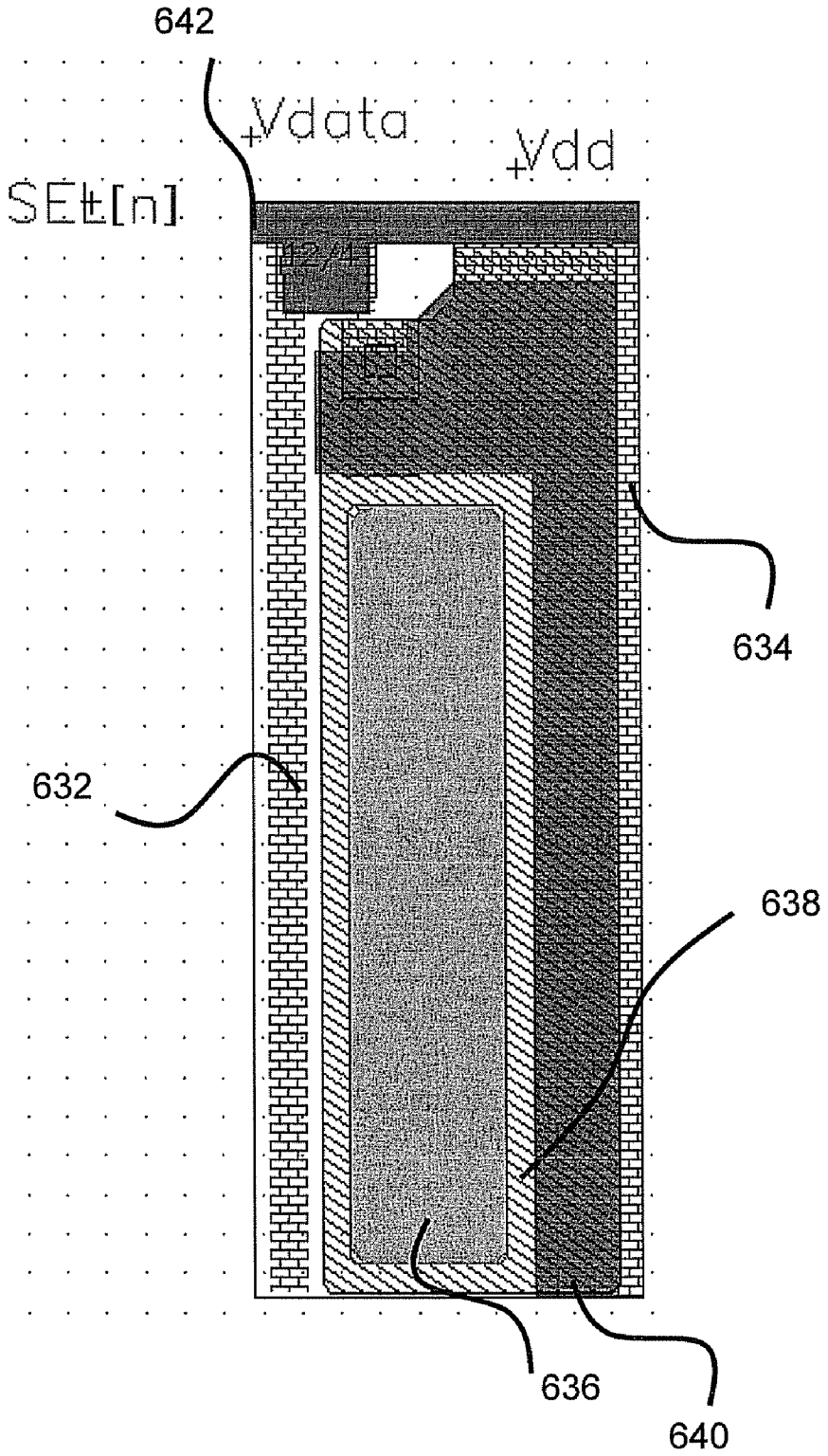
FIG. 26 illustrates an example of a layout of the bottom emission pixel.

Referring to FIG. 26, there is illustrated an example of the layout of a bottom emission pixel with over 25% aperture ratio for 180-ppi display resolution. In FIG. 26, multiple layers have been used to create a large capacitance for pixel circuit shown in FIG. 20A. Here the capacitor is created out of three layers: metal II 634 sandwiched between ITO 638 and metal I 640. The metal layers 634 and 640 form the capacitor 504 of FIG. 20A. The metal I layer 640 may correspond to 602 of FIG. 25; the metal II layer 634 corresponds to 604 of FIG. 25. The data line 632 is used to program the pixel with a voltage. The OLED bank 636 is the opening that allows OLED contacts the patterned OLED electrode. The select line 642 is used to turn on the select transistor for providing access to the pixel for programming.

Figure 27:
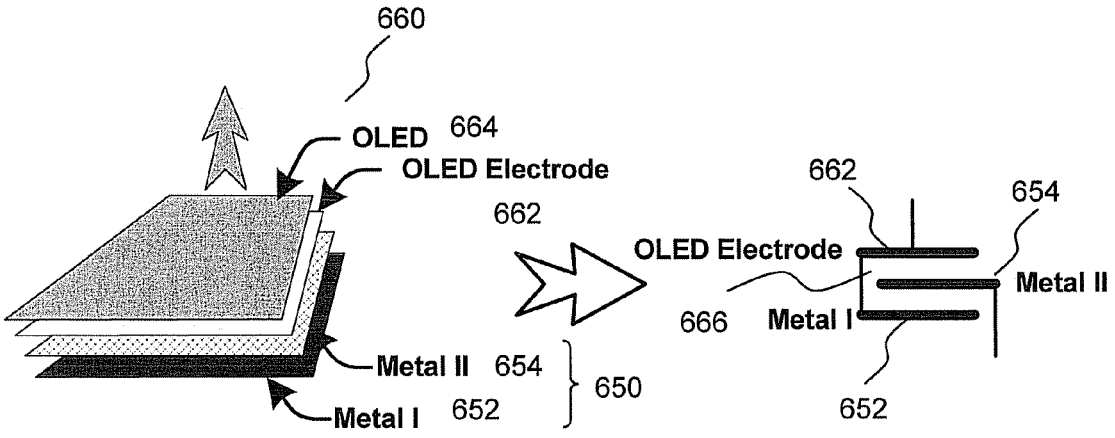
FIG. 27 illustrates an example of the implementation of a capacitor for driving a top emission display.

Referring to FIG. 27, there is illustrated an example of the implementation of a large capacitor for driving a top emission display. A capacitor 650 shown in FIG. 27 is an inter-digitated capacitor and is usable as the driving capacitor 10 of FIG. 1 and/or a storage capacitor of a pixel circuit. The capacitors 504 and 524 of FIGS. 20A-20B may be the inter-digitated capacitor 650. The inter-digitated capacitor 650 includes a metal I layer 652 and a metal II layer 654. The OLED device 660 is formed on the inter-digitated capacitor 650, which at least has a bottom electrode 662 and a OLED layer 664. The OLED layer 664 is located on the bottom electrode 662. The metal I electrode layer 652 is coupled to the OLED bottom electrode 662 via an interconnection line 566. This can results in large capacitor without sacrificing the display resolution.

Figure 28:
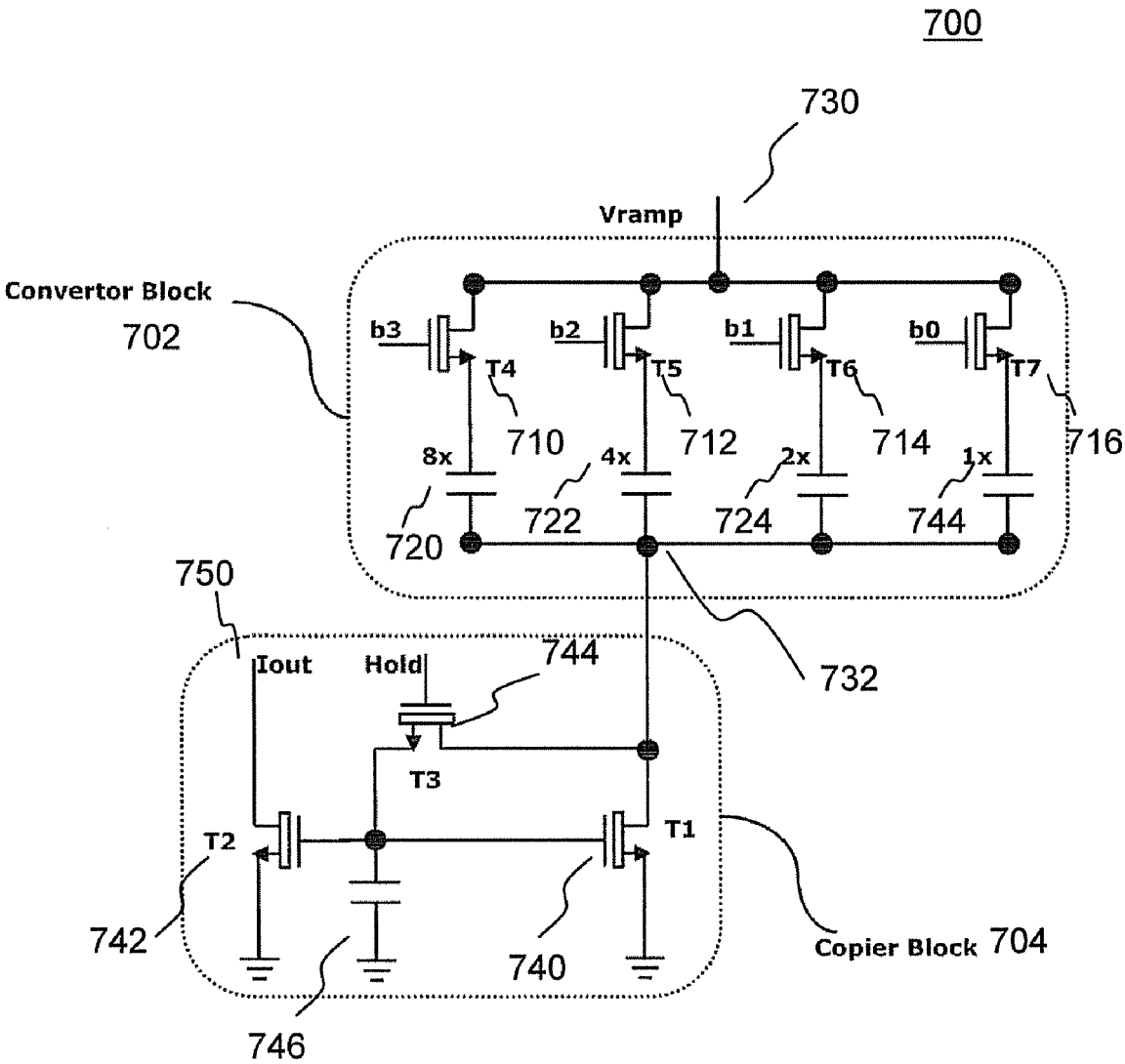
FIG. 28 illustrates an example of a digital to analog convertor (DAC) based on capacitive driving.
Figure 29:
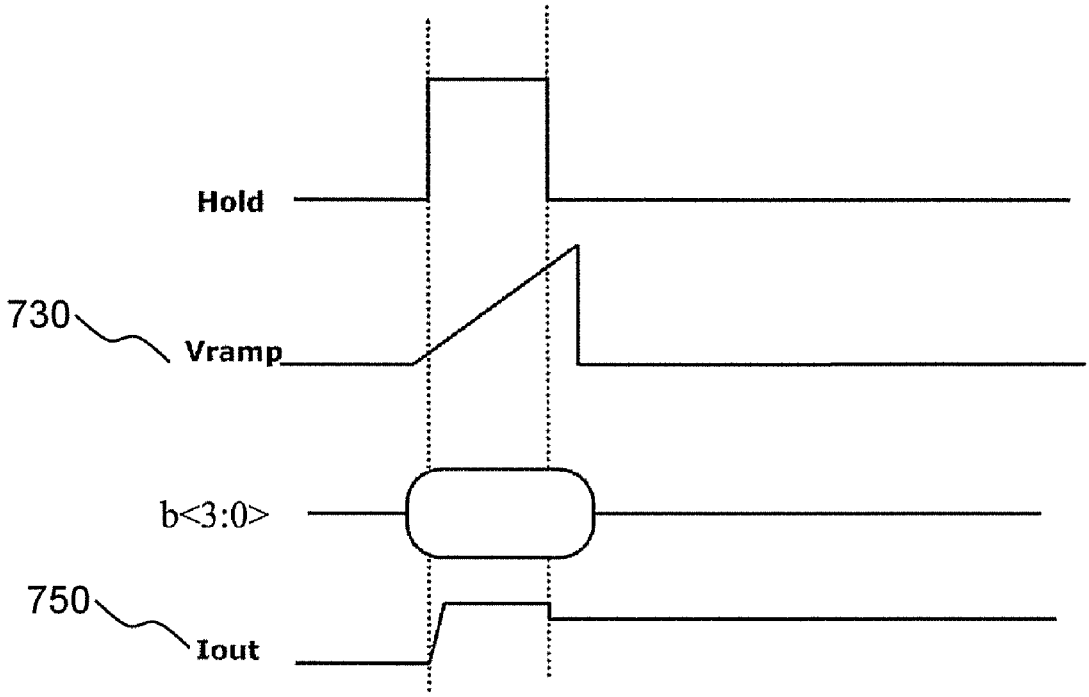
FIG. 29 illustrates an example of a timing diagram for the DAC of FIG. 28.

Digital to analog convertors (DAC) based on capacitive driving are described in detail. Reference to FIGS. 28-29, there are illustrated one example of a DAC based on the capacitive driving and its operation. The DAC 700 of FIG. 28 includes a convertor block 702 and a copier block 704. The convertor block 702 includes a plurality of transistors and a plurality of capacitors. In FIG. 28, switch transistors 710, 712, 714 and 716 and capacitors 720, 722, 724 and 726 are shown as one example of the components of the convertor block 702. The transistor and the capacitor are coupled in series between Vramp node 730 and node 732. The capacitors 720, 722, 724 and 726 are sized differently. Vramp node 730 may be coupled to a ramp voltage generator, e.g., 12 of FIG. 1. The convertor block 702 generates current.

The copier block 704 is coupled to the convertor block 702 at node 732, and includes transistors 740, 742 and 744 and a capacitor 746. The transistor 740 copies the current generated by the convertor block 702. The transistor 742 applies the current to any external circuitry including pixel circuits, via Iout 750.

During generating the current in the convertor block 702, the transistors 710, 712, 714 and 716 are either ON or OFF based on the corresponding bit values b3 to b0 (b<3:0>). As a result, a ramp voltage Vramp is applied to the capacitor which is connected to the ON switch (transistor). Since the capacitors are sized differently each will generate a current representing the value of its corresponding bit in a digital metrics. For example if b<3:0> is "1010", two capacitors (e.g., 720 and 724 of FIG. 28) will be connected to the ramp voltage (730). As a result, a current equal to 8C*S+2C*S will be generated where C is the unit capacitor and S is the slope of the ramp. The capacitor will convert the ramp to a current. The sum of the current will go to the transistor 740 which copies them when the transistor 744 is ON.

In the example of FIG. 28, the current generated by the convertor block 702 is provided via the copier block 704. However, in another example, the convertor block 702 may be directly connected to an external circuitries including pixel circuits.

Figure 30:
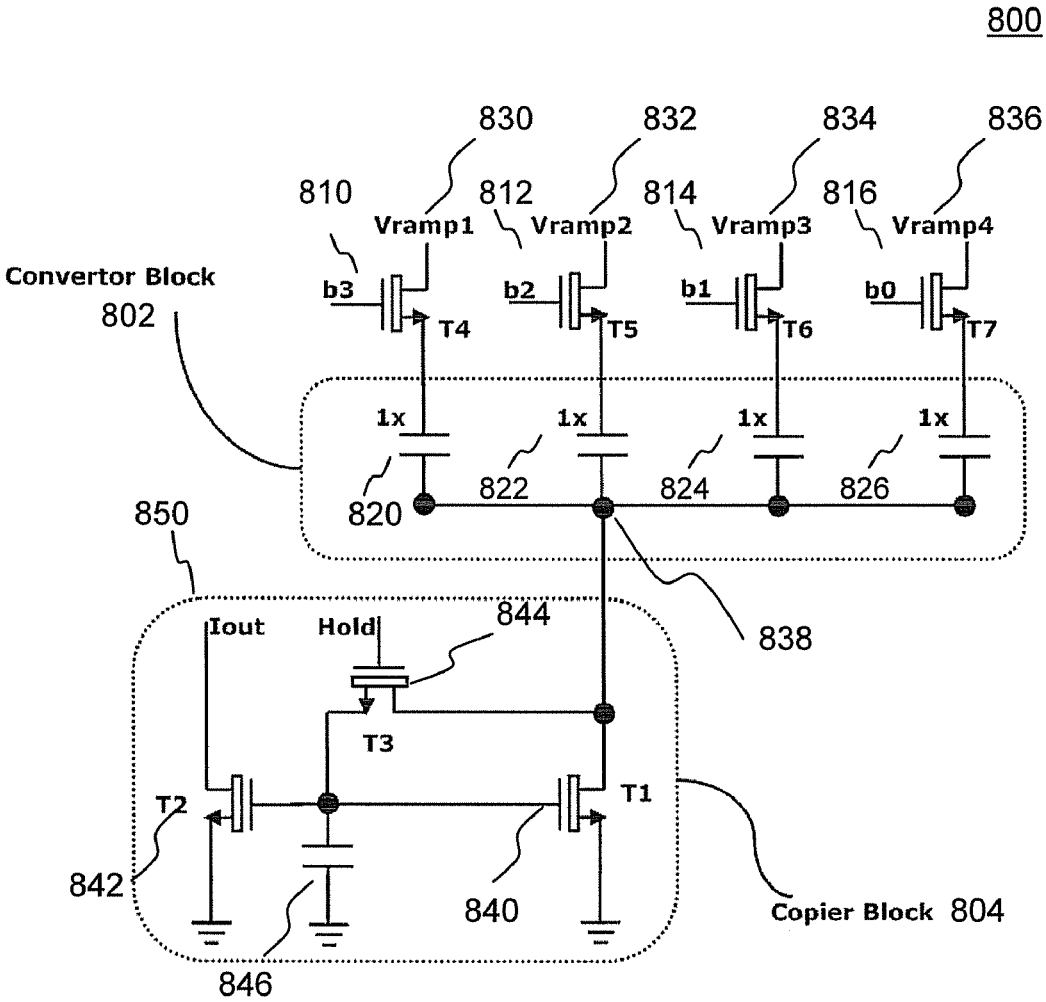
FIG. 30 illustrates another example of a digital to analog convertor (DAC) based on capacitive driving.
Figure 31:
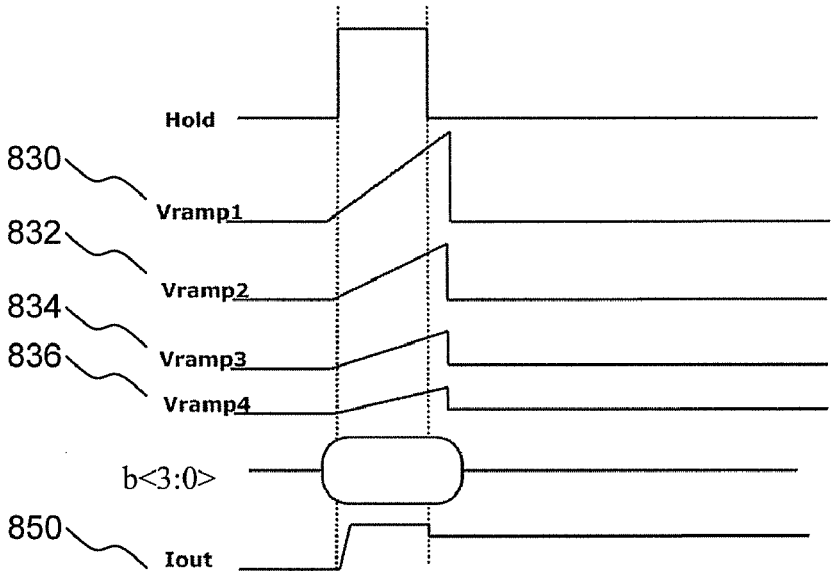
FIG. 31 illustrates an example of a timing diagram for the DAC of FIG. 30.

Reference to FIGS. 30-31, there are illustrated another example of the DAC based on the capacitive driving and its operation. The DAC 800 of FIG. 30 includes a convertor block 802 and a copier block 804. The convertor block 802 includes a plurality of capacitors, each coupling to a switch transistor. In FIG. 30 capacitors 820, 822, 824 and 826 are shown as one example of the components of the convertor block 802, and switch transistors 810, 812, 814, and 816 are coupled to the capacitors 820, 822, 824 and 826, respectively The transistors 810, 812, 814, and 816 are coupled to Vramp nodes 830, 832, 834, and 836 to receive Vramp1, Vramp2, Vramp3, and Vramp4, respectively. The capacitors 820, 822, 824 and 826 may have the same sizes. Each of Vramp nodes 830, 832, 834, and 836 may be coupled to a ramp voltage generator, e.g., 12 of FIG. 1. Ramp voltages Vramp1, Vramp2, Vramp3, Vramp4 on Vramp nodes 830, 832, 834, and 836 are different each other. The convertor block 802 generates current.

The copier block 804 is coupled to the convertor block 802 at node 838, and includes transistors 840, 842 and 844 and a capacitor 846. The transistor 840 copies the current generated by the convertor block 802. The transistor 842 applies the current to any external circuitry including pixel circuits via tout 850. The copier block 804 corresponds to the copier block 704 of FIG. 28.

In the example of FIG. 30, the ramp slope applied to each capacitor is changed, instead of sizing the capacitor. While the basic operation of the circuit is the same as that of FIG. 28, the current level is defined by different ramp slope. For example if b<3:0> is "1010", two capacitors (e.g., 820 and 824 of FIG. 30) will be connected to the ramps (e.g., 830 and 834 of FIG. 30). As a result, a current equal to C*8S+C*2S will be generated where C is the capacitor and S is the unit slope of the ramp.

The above embodiments of the present invention can reduce power consumption associated with backplane technologies of different material systems, including thin film silicon (e.g. a-Si, nc-Si, μc-Si, poly-Si) and related Si integrated circuit CMOS technologies, vacuum deposited and solution processed organic and polymers, and related inorganic/organic nanocomposites, and semiconducting oxides (e.g., indium oxide, zinc oxides). Further, the above embodiments of the present invention allow using low cost driving scheme for application for longer lifetime requirements. Also it is insensitive to the temperature change and mechanical stress.

What is claimed is:

1. A driver for driving a display system, comprising:

a bidirectional current source for providing a current to a display system, including:

a convertor coupling to a time-variant voltage, for converting the time-variant voltage to the current, and a controller for controlling the generation of the time-variant voltage.

2. A driver according to claim 1, wherein the convertor comprises:

a capacitor.

3. A driver according to claim 2, wherein the display system comprises a plurality of pixel circuits arranged in columns and rows, and wherein the capacitor is allocated to each column to operate a pixel circuit in the column, and the time-variant voltage may be shared in one or more than one column.

4. A driver according to claim 2, wherein the capacitor is a storage capacitor of a pixel circuit in the display system, and acts as the current source in conjunction with the time-variant voltage.

5. A driver according to claim 4, wherein the time-variant voltage having a slope is provided to the storage capacitor during a programming cycle or a driving cycle of the pixel circuit.

6. A driver according to claim 1, wherein the current from the current source is provided to a pixel circuit in the display system as a bias current or a programming current.

7. A driver according to claim 1, wherein the convertor comprises:

a plurality of capacitors coupling to an output node for providing the current, each having a different size and receiving the time-variant voltage based on a control signal.

8. A driver according to claim 1, wherein the convertor is coupled to a plurality of time-variant voltages, and wherein the convertor comprises:

a plurality of capacitors coupling to an output node for providing the constant current, each receiving a corresponding time-variant voltage based on a control signal.

9. A driver according to claim 1, comprising:

a copier block for copying the current generated by the convertor, and providing the copied current to the display system.

10. A driver according to claim 1, wherein the convertor comprises an inter-digitated capacitor having a plurality of layers, one of the layers of the inter-digitated capacitor being interconnected to an electrode of a light emitting device in a pixel circuit.

11. A driver according to claim 1, wherein a pixel circuit comprises:

an inter-digitated capacitor having a plurality of layers; and an organic light emitting diode (OLED) device having an electrode and an OLED layer, one of the layers of the inter-digitated capacitor being interconnected to the electrode.

12. A pixel circuit, comprising:

a transistor for providing a pixel current to a light emitting device; and a storage capacitor electrically coupling to the transistor, the capacitor coupling to a time-variant voltage in a predetermined timing for providing a current based on the time-variant voltage.

13. A pixel circuit according to claim 12, wherein the storage capacitor is coupled to a data line for providing programming data, and receives the time-variant voltage having a slope via the data line in a part of a programming cycle.

14. A pixel circuit according to claim 13, wherein the transistor is a driving transistor having a gate, a first terminal and a second terminal, the capacitor being coupling between the data line and the gate of the driving transistor.

15. A pixel according to claim 14, comprising a switch transistor coupling the gate of the driving transistor and one of the first and second terminals of the driving transistor, the switch transistor being on until the time-variant voltage reaching the programming voltage during a programming cycle.

16. A pixel circuit according to claim 12, wherein the storage capacitor is coupled between a power supply line and the light emitting device, and receives the time-variant voltage having a slope via the power supply line during a driving cycle.

17. A pixel circuit according to claim 16, wherein the transistor is a switch transistor coupling between a data line for providing programming data and the storage capacitor.

18. A pixel according to claim 12, wherein the capacitor is an inter-digitated capacitor having a plurality of layers, one of the layers of the inter-digitated capacitor being interconnected to an electrode of the light emitting device.

19. A method of operating a pixel circuit, comprising:

in a first cycle in a programming operation, changing a time-variant voltage provided to a storage capacitor in a pixel circuit, from a reference voltage to a programming voltage, the storage capacitor electrically coupling to a driving transistor for driving a light emitting device; and in a second cycle in the programming operation, maintaining the time-variant voltage at the programming voltage.

20. A method according to claim 19, wherein the pixel circuit comprises a switch transistor coupling to the storage capacitor and the gate terminal of the driving transistor, and comprising:

turning on the switch transistor in the first cycle; and turning off the switch transistor in the second cycle.

21. A method of operating a pixel circuit, comprising:

in a programming operation, providing programming data to a pixel circuit from a data line, the pixel circuit including a transistor coupling to the data line and a storage capacitor; and in a driving operation, providing, to the storage capacitor in the pixel circuit via a power supply line, a time-variant voltage for turning on a light emitting device.

22. A method according to claim 21, wherein the pixel circuit is arranged in each column and row, in the programming operation, sequentially programming the pixels.

23. A pixel circuit comprising:

an organic light emitting diode (OLED) device having an electrode and an OLED layer; and an inter-digitated capacitor having a plurality of layers, for operating the OLED, the OLED device being disposed on the plurality of layers, one of the layers of the inter-digitated capacitor being interconnected to the electrode of the OLED.

24. A pixel circuit according to claim 23, wherein the pixel circuit is a bottom emission pixel circuit so that the plurality of layers of the capacitor are placed under the electrode without covering light from the OLED layer on the transparent electrode, or wherein the pixel circuit is a top emission pixel circuit having the OLED layer and the electrode arranged on the plurality of layers of the capacitor.

25. A pixel circuit according to claim 23, wherein the capacitor acts as a current source in conjunction with a ramp voltage.

* * * * *